US009146526B2

(12) United States Patent
Yamaguchi et al.

(10) Patent No.: US 9,146,526 B2
(45) Date of Patent: Sep. 29, 2015

(54) UNIT, CLEANING UNIT, PROCESS CARTRIDGE, AND IMAGE FORMING APPARATUS

(71) Applicant: CANON KABUSHIKI KAISHA, Tokyo (JP)

(72) Inventors: Noritomo Yamaguchi, Kawasaki (JP); Yuichi Fukui, Yokosuka (JP); Hiroyuki Munetsugu, Yokohama (JP); Toshiki Fujino, Kawasaki (JP); Tetsuya Numata, Suntou-gun (JP); Fumito Nonaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 14/019,764

(22) Filed: Sep. 6, 2013

(65) Prior Publication Data

US 2014/0072326 A1 Mar. 13, 2014

(30) Foreign Application Priority Data

Sep. 13, 2012 (JP) ..... 2012-201857
Sep. 13, 2012 (JP) ..... 2012-201898

(51) Int. Cl.
*G03G 15/00* (2006.01)
*G03G 21/00* (2006.01)

(52) U.S. Cl.
CPC ..... *G03G 21/007* (2013.01); *G03G 21/0011* (2013.01)

(58) Field of Classification Search
CPC ..... G03G 15/0898; G03G 15/0812; G03G 21/1832; G03G 2221/1648; G03G 2215/0877; G03G 21/007
USPC ..... 399/102, 103, 111, 119, 343, 350
See application file for complete search history.

(56) References Cited

U.S. PATENT DOCUMENTS 6,115,565 A * 9/2000 Noda ..... 399/102
6,356,730 B1 3/2002 Nonaka
7,885,594 B2 * 2/2011 Fujii ..... 399/343

(Continued)

FOREIGN PATENT DOCUMENTS

CN 101639656 A 2/2010
CN 102200721 A 9/2011

(Continued)

OTHER PUBLICATIONS

Office Action dated Jul. 15, 2015, in Chinese Patent Application No. 201310415646.1.

*Primary Examiner* — Francis Gray
(74) *Attorney, Agent, or Firm* — Fitzpatrick, Cella, Harper & Scinto

(57) ABSTRACT

A cleaning unit usable with an image forming apparatus includes a cleaning blade, supported by a frame and including a free end contactable to an image bearing drum, for removing a developer from the drum; a first seal provided between the frame and the blade by injection molding into the frame adjacent to a longitudinal end portion of the blade, the first seal being effective to prevent developer leakage; and a second seal provided between the drum and the frame in contact with the free end of the blade adjacent to the longitudinal end portion, wherein the first seal includes a seal portion contacting the blade, and a seat supporting the second seal, the seat being deformable to move the second seal to urge the second seal to the free end of the blade when the drum is mounted to the frame.

28 Claims, 19 Drawing Sheets

(56) References Cited

U.S. PATENT DOCUMENTS

| | | | | |
|---|---|---|---|---|
| 8,320,792 | B2 | 11/2012 | Kawakami et al. | |
| 8,855,524 | B2 | 10/2014 | Nakajima et al. | |
| 2007/0134020 | A1 | 6/2007 | Lee et al. | |
| 2012/0163855 | A1 | 6/2012 | Seo et al. | |
| 2013/0121720 | A1* | 5/2013 | Hoshi et al. | 399/106 |
| 2013/0129375 | A1* | 5/2013 | Yamasaki et al. | 399/103 |
| 2013/0129378 | A1* | 5/2013 | Hoshi et al. | 399/106 |
| 2014/0037324 | A1* | 2/2014 | Matsuda | 399/102 |

FOREIGN PATENT DOCUMENTS

| | | | |
|---|---|---|---|
| JP | 2005-234164 | A | 9/2005 |
| JP | 2006-184429 | A | 7/2006 |
| JP | 2010-002680 | A | 1/2010 |

* cited by examiner (a)

(b)

UNIT, CLEANING UNIT, PROCESS CARTRIDGE, AND IMAGE FORMING APPARATUS

FIELD OF THE INVENTION AND RELATED ART

The present invention relates to a unit, a cleaning unit, a process cartridge, and an image forming apparatus.

Some electrophotographic image forming apparatuses, such as a printer which uses an electrophotographic process, have been known to be equipped with a cleaning unit which removes the toner, as developer, remaining on a photosensitive drum, as an image bearing component, on which a toner image is formed. A cleaning unit is provided with a cleaning unit frame, and a cleaning blade supported by the frame so that it remains in contact with the photosensitive drum. The waste toner removed by the cleaning blade is stored in the waste toner storage.

At this time, referring to FIG. 12, a conventional toner sealing structure is described. In FIG. 12, (a) is a plan view of the conventional cleaning unit. It shows, the structural arrangement of the unit, which is for preventing waste toner leakage. In FIG. 12, (b) is a sectional view of the cleaning unit, at a plane W-W in (a) of FIG. 12(*a*). In FIG. 12, (c) is an enlarged view of a part of (b) of FIG. 12. Hereafter, the direction (indicated by arrow mark X in (a) of FIG. 12), which is parallel to the axial line of the rotational axle of the photosensitive drum 4 will be referred to as the lengthwise direction.

Referring to (a) of FIG. 12, the cleaning unit 8 is provided with a pair of elastic components 86 (86R and 86L), which are in the adjacencies of the lengthwise ends of the cleaning blade 7, one for one. The elastic components 86R and 86L prevent the waste toner stored in the waste toner storage 26*a*, from leaking through the gap between the photosensitive drum 4 and cleaning blade 7.

Also referring to (a) of FIG. 12, the cleaning unit 8 is provided with a pair of cleaning blade end seals (which hereafter will referred to simply as end seal) 85R and end seal 85L, which prevent the waste toner from leaking through the gap between the cleaning unit frame 26 and photosensitive drum 4. The end seals 85R and 85L are the same in shape, and are symmetrically positioned with reference to the center of the cleaning unit 8 in terms of the lengthwise direction. Thus, it is only the elastic member 86R that is described hereafter; the end seal 85L is not described.

Referring to (c) of FIG. 12, the end seal 85R is to be positioned on top of the elastic component 86R. During the assembly of the cleaning unit, the end seal 85R is pasted to the cleaning unit frame 26 before the cleaning blade 7. Thus, it is necessary to prevent the cleaning blade 7 from overlapping with the end seal 85R. Thus, it was necessary to provide a gap 60 between the end seal 85R and cleaning blade 7.

An example of the means for providing the gap 60 is disclosed in Japanese Laid-open Patent Application No. 2005-234164. According to this application, the end seals 85R and 85L are roughly L-shaped; they are provided with protrusive portions 85*a*R and 85*a*L, as shown in (a) of FIG. 12. These protrusive portions 85*a*R and 85*a*L prevent the toner leakage which might occur at the lengthwise end surfaces 7*f*R and 7*f*L of the cleaning blade 7.

However, in the case of the above-described structural arrangement for preventing the waste toner leakage, the end seal had to be highly precisely pasted to the cleaning unit frame to prevent the toner from leaking through the gap between the end seal and cleaning blade. Similarly, the end seals and cleaning blade had to be highly precisely positioned relative to each other. This sometimes adds to the cost for manufacturing a cleaning unit. Further, providing the end seal 85 with the protrusive portion 85*a* increases the cost for manufacturing a cleaning unit by an amount proportional to the increase in the size of the end seal.

Further, in the case of the cleaning unit disclosed in Japanese Laid-open Patent Application No. 2005-234164, in order to prevent the toner leakage, the seals are pasted to the bracket with which the cleaning unit frame is provided, and the bracket is pressed upon the rotational component by pressing component. Further, they are pressed toward the rotational axis of the rotational component. This type of structural arrangement, however, increases the cleaning unit in component count, which in turn increases the cleaning unit in manufacture cost.

SUMMARY OF THE INVENTION

Thus, the primary object of the present invention is to provide a cleaning unit which is lower in cost, and yet, is substantially better sealed in terms of developer leakage, than any cleaning unit in accordance with the prior art.

According to an aspect of the present invention, there is provided a cleaning unit usable with an image forming apparatus, said cleaning unit comprising a frame: a developer accommodating portion for accommodating a developer; a cleaning blade, supported by said frame and including a free end contactable to an image bearing member, for removing a developer from the image bearing member; a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member includes a seal portion contacting said cleaning blade, and a seat portion to which at least a part of said second sealing member is mounted, said seat portion is deformable to move said second sealing member in a direction of urging said second sealing member to the free end of said cleaning blade when the image bearing member is mounted to said frame.

According to another aspect of the present invention, there is provided a cleaning unit usable with an image forming apparatus, said cleaning unit comprising a frame; a developer accommodating portion for accommodating a developer; a cleaning blade, supported by said frame and including a free end contactable to an image bearing member, for removing a developer from the image bearing member; a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member is deformable toward said second sealing member by said cleaning blade being mounted to said frame.

According to a further aspect of the present invention, there is provided a process cartridge detachably mountable to a main assembly of an image forming apparatus, said process cartridge comprising an image bearing member; a frame; a developer accommodating portion for accommodating a developer; a cleaning blade, supported by said frame and including a free end contactable to an image bearing member, for removing a developer from the image bearing member; a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member includes a seal portion contacting said cleaning blade, and a seat portion to which at least a part of said second sealing member is mounted, said seat portion is deformable to move said second sealing member in a direction of urging said second sealing member to the free end of said cleaning blade when the image bearing member is mounted to said frame.

According to a further aspect of the present invention, there is provided a process cartridge detachably mountable to a main assembly of an image forming apparatus, said process cartridge comprising an image bearing member; a frame; a developer accommodating portion for accommodating a developer; a cleaning blade, supported by said frame and including a free end contactable to an image bearing member, for removing a developer from the image bearing member; a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member is deformable toward said second sealing member by said cleaning blade being mounted to said frame.

According to a further aspect of the present invention, there is provided an image forming apparatus for forming an image on a recording material, said image forming apparatus comprising (i) a process cartridge dismountably mounted to a main assembly of said apparatus, said process cartridge including, an image bearing member, a frame, a developer accommodating portion for accommodating a developer; a cleaning blade, supported by said frame and including a free end contactable to an image bearing member, for removing a developer from the image bearing member, a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member includes a seal portion contacting said cleaning blade, and a seat portion to which at least a part of said second sealing member is mounted, said seat portion is deformable to move said second sealing member in a direction of urging said second sealing member to the free end of said cleaning blade when the image bearing member is mounted to said frame; and (ii) feeding means for feeding the recording material.

According to a further aspect of the present invention, there is provided an image forming apparatus for forming an image on a recording material, said image forming apparatus comprising a process cartridge dismountably mounted to a main assembly of said apparatus, said process cartridge including, an image bearing member, an image bearing member, a frame, a developer accommodating portion for accommodating a developer; a cleaning blade, supported by said frame and including a free end contactable to an image bearing member, for removing a developer from the image bearing member; a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member is deformable toward said second sealing member by said cleaning blade being mounted to said frame; and (ii) feeding means for feeding the recording material.

According to a further aspect of the present invention, there is provided a unit usable with an image forming apparatus, said unit comprising a frame; a developer accommodating portion for accommodating a developer; a blade supported by said frame and including a free end contactable to a rotatable member; a first sealing member provided between said frame and said blade by injection molding into said frame adjacent to a longitudinal end portion of said blade, said first sealing member being effective to prevent leakage of the developer from said developer accommodating portion; a second sealing member provided between the image bearing member and said frame in contact with the free end of said blade adjacent to the longitudinal end portion, wherein said first sealing member includes a seal portion contacting said blade, and a seat portion to which at least a part of said second sealing member is mounted, said seat portion is deformable to move said second sealing member in a direction of urging said second sealing member to the free end of said blade when the image bearing member is mounted to said frame.

According to a further aspect of the present invention, there is provided a unit usable with an image forming apparatus, said unit comprising a frame; a developer accommodating portion for accommodating a developer; a blade supported by said frame and including a free end contactable to a rotatable member; a first sealing member provided between said frame and said blade by injection molding into said frame adjacent to a longitudinal end portion of said blade, said first sealing member being effective to prevent leakage of the developer from said developer accommodating portion; a second sealing member provided between the image bearing member and said frame in contact with the free end of said blade adjacent to the longitudinal end portion, wherein said first sealing member is deformable toward said second sealing member by said blade being mounted to said frame.

Further features of the present invention will become apparent from the following description of exemplary embodiments (with reference to the attached drawings).

DESCRIPTION OF THE PREFERRED EMBODIMENTS

Hereinafter, embodiments of the present invention are described with reference to the appended drawings. However, the measurements, materials, and shapes of the structural components of the image forming apparatuses in the following embodiments of the present invention, and the positional relationship among the components, are not intended to limit the present invention in scope. They are to be altered as necessary, according to the structure of an apparatus to which the present invention is applied, and various conditions under which the apparatus is used.

Embodiment 1

The image forming apparatus in this embodiment is an electrophotographic image forming apparatus (which may be referred to simply as image forming apparatus, hereafter). More specifically, it is an electrophotographic full-color image forming apparatus in which four process cartridges (which may be referred to simply as cartridges) are disposed. However, the number of the cartridges installable in the apparatus is not limited to four. It is to be set as necessary. For example, in the case of an image forming apparatus which forms a monochromatic image, the number of cartridges to be installed in the apparatus is one. Although, the image forming apparatus in this embodiment is a full-color laser printer which is based on four primary colors and uses an electrophotographic process. However, this embodiment is not intended to limit the present invention in terms of an image forming apparatus to which the present invention is applicable. For example, the present invention is also applicable to a copying machine, a facsimile machine, and a multifunction machine capable of performing as a copying machine as well as a facsimile machine.

<General Structure of Image Forming Apparatus>

Figure 2:
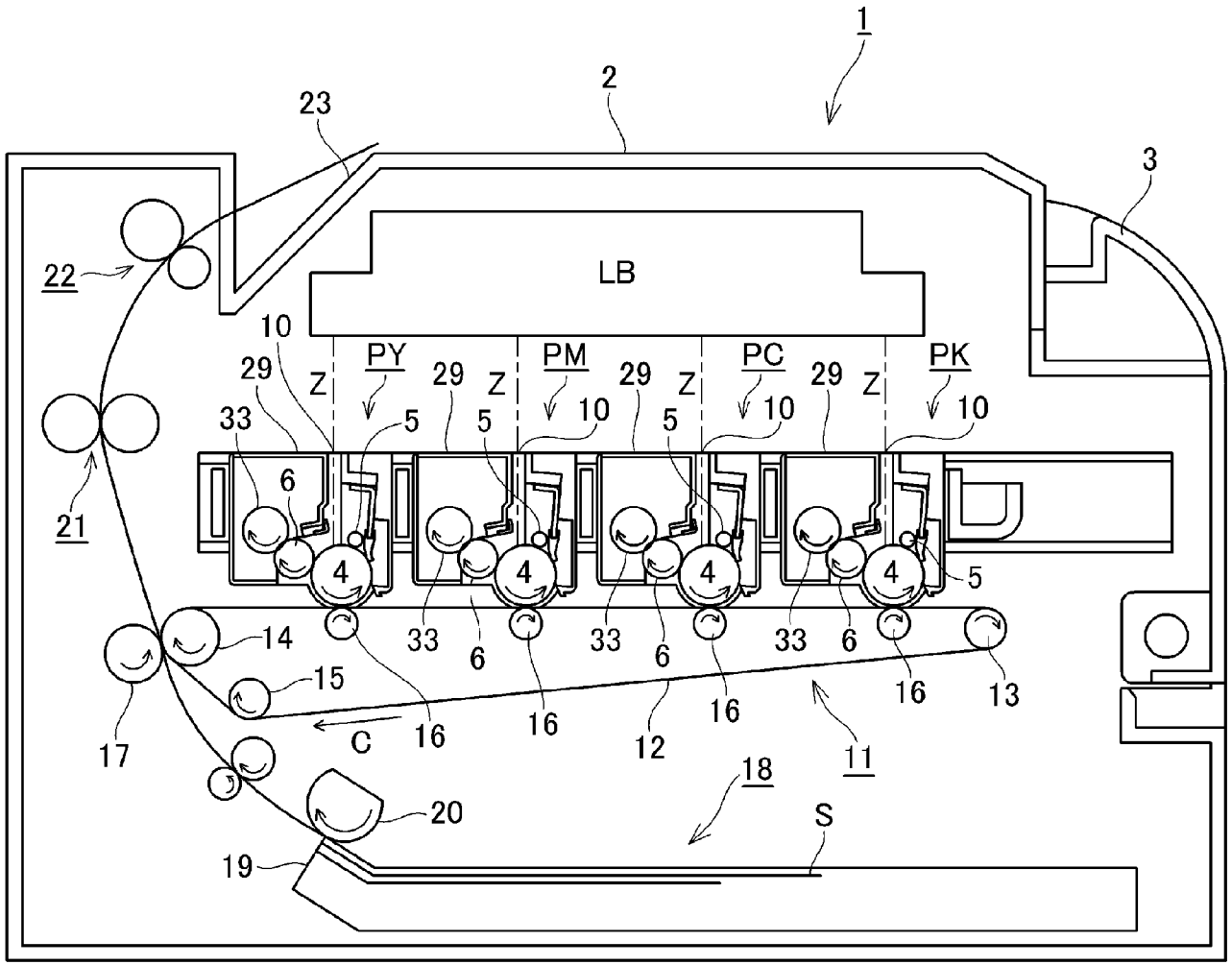
FIG. 2 is a schematic sectional view of the image forming apparatus in the first embodiment, and shows the general structure of the apparatus.
Figure 3:
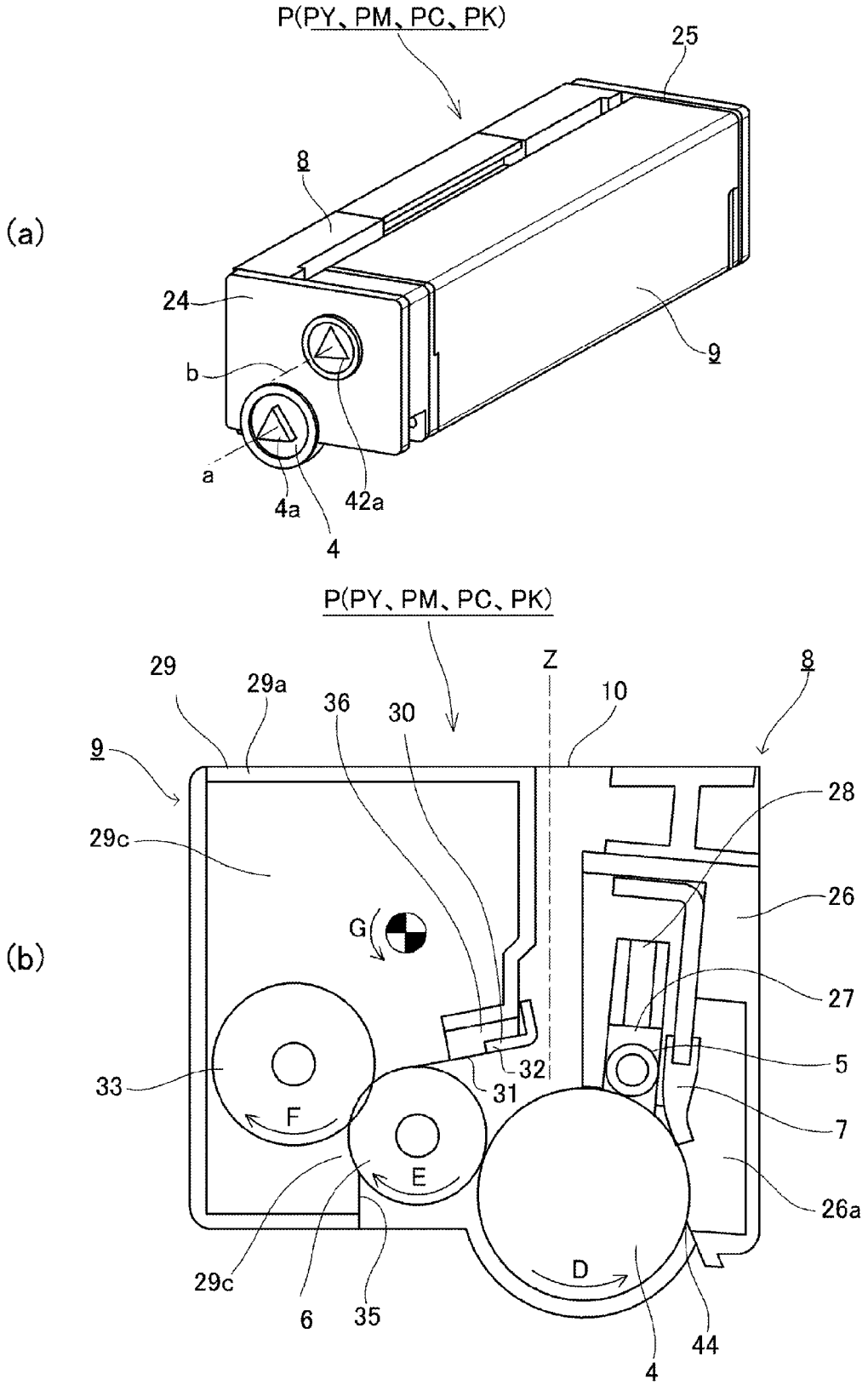
FIG. 3 is a drawing of the process cartridge in the first embodiment.

First, referring to FIGS. 2 and 3, the general structure of the image forming apparatus in the first embodiment is described. FIG. 2 is a schematic sectional view of the image forming apparatus in this embodiment. FIG. 3(*a*) is an external perspective view of the process cartridge in the first embodiment. FIG. 3(*b*) is a schematic sectional view of the process cartridge in the first embodiment. This image forming apparatus 1 is a full-color laser printer which uses an electrophotographic image formation process, and is based on four primary colors. It forms a color image on a sheet S of recording medium. It employs the so-called process cartridge system. That is, it is structured so that process cartridges P (PY, PM, PC and PK) (which will be referred to simply as cartridges) are removably installable in the main assembly 2 of the image forming apparatus to form a color image on a sheet S of recording medium.

Regarding the direction of the image forming apparatus 1, the side of the image forming apparatus 1, which is provided with a door 3 will be referred to as the front surface, and the opposite surface from the front surface will be referred to as the rear surface. Further, the right and left sides of the image forming apparatus 1, as seen from the front side, will be referred to as the drive side and non-drive side, respectively. FIG. 2 is a sectional view of the image forming apparatus 1, as seen from the non-drive side. Thus, the front side of the sheet of paper which has FIG. 2 corresponds to the non-drive side of the image forming apparatus 1, and the left side of the sheet corresponds to the front side of the image forming apparatus 1. Further, the backside of the sheet corresponds to the drive side of the image forming apparatus 1.

Referring to FIG. 2, there are disposed in the apparatus main assembly 2, four cartridges P (PY, PM, PC and PK), more specifically, the first, second, third, and fourth cartridges PY, PM, PC and PK, respectively, being horizontally aligned in parallel. The first to fourth cartridges P (PY, PM, PC and PK) have four electrophotographic image processing systems, one for one, which are the same in function. To the first to fourth cartridges P (PY, PM, PC and PK), rotational driving force is transmitted from the driving force output portion (unshown) of the apparatus main assembly 2. Further, to the first to fourth cartridges P (PY, PM, PC and PK), bias voltages (charge bias, development bias, etc.) are supplied from the apparatus main assembly 2.

Referring to FIG. 3(*a*), each of the first to fourth cartridges P (PY, PM, PC and PK) in this embodiment has a photosensitive drum 4 as an image bearing member, and a cleaning unit 8. The cleaning unit 8 is equipped with a charging means as a means which processes the photosensitive drum 4, and a cleaning means. Further, each of the cartridges P (PY, PM, PC and PK) has a development device 9 equipped with a developing means for developing the electrostatic latent image on the photosensitive drum 4. The cleaning unit 8 and development device 9 are in connection to each other. As the charging means, a charge roller 5 is used. As the cleaning means, a cleaning blade 7 is used. As a developing means, a development roller (developer bearing component) 6 is used.

The first cartridge PY stores toner of yellow (Y) color, in its development frame 29. It forms a toner image (developer image) of yellow color on the peripheral surface of the photosensitive drum 4. The second cartridge PM stores toner of magenta (M) color in its development frame 29. It forms a toner image of the color on its photosensitive drum 4. The third cartridge PC stores toner of cyan (C) color in its development frame 29. It forms a toner image of the cyan color on the peripheral surface of the photosensitive drum 4. The fourth cartridge PK stores toner of black (K) color in its development frame 29. It forms toner image of the black color on the peripheral surface of its photosensitive drum 4.

Referring to FIG. 2, there is disposed a laser scanner unit LB as exposing means, above the combination of the first to fourth cartridges P (PY, PM, PC and PK). This laser scanner unit LB outputs a beam Z of laser light while modulating the beam Z according to the information of the image to be formed. The beam Z of laser light scans (exposes) the peripheral surface of the photosensitive drum 4, through an exposure window 10 of the cartridge P.

Figure 12:
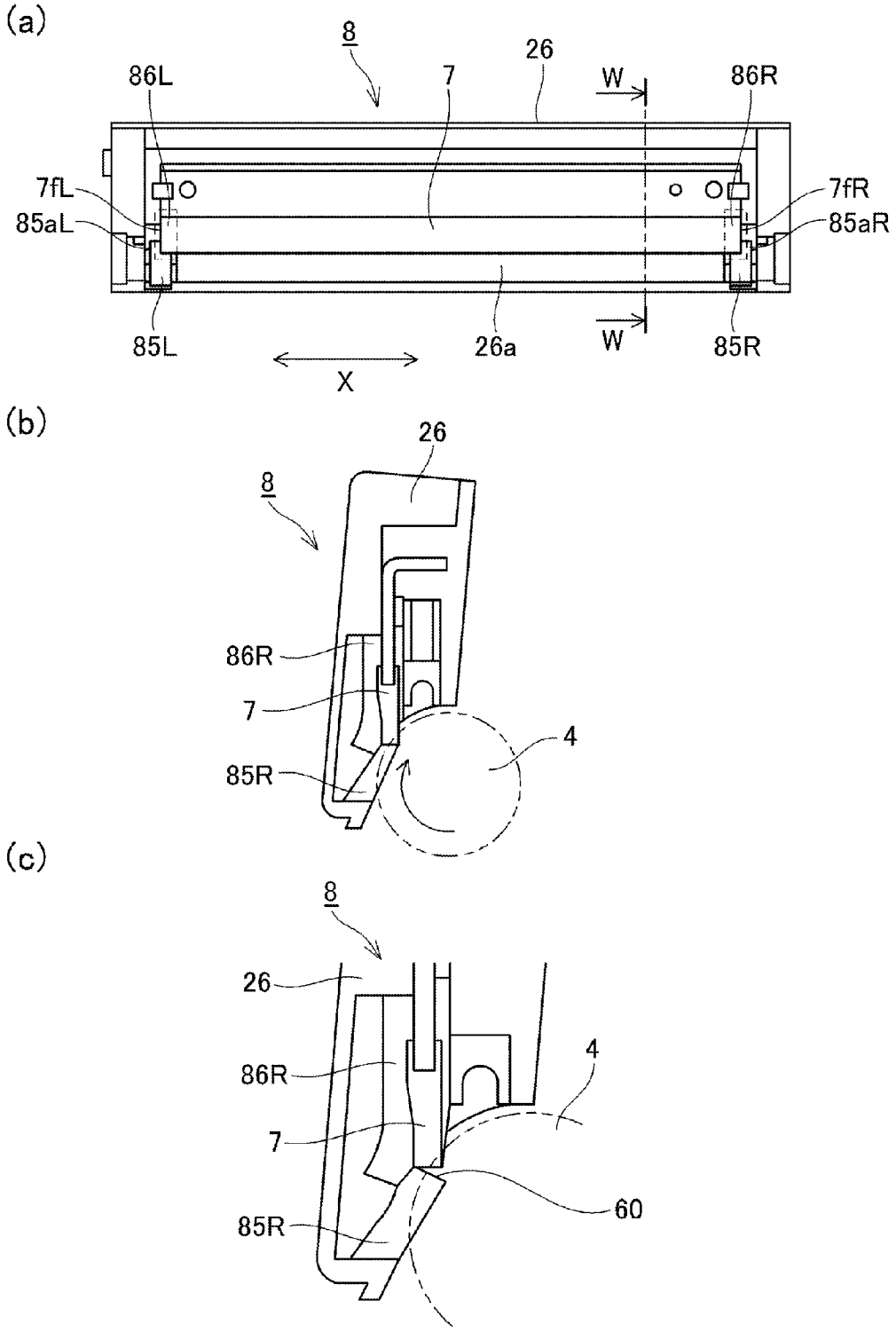
FIG. 12 is a drawing of a conventional cleaning unit.

Referring also to FIG. 2, there is disposed an intermediary transfer belt unit 11, as a transfer component, below the combination of the first to fourth cartridges P (PY, PM, PC and PK). This intermediary transfer belt unit 11 has: a flexible endless belt 12; and a combination of a driver roller 13, a turn roller 14, and a tension roller 15, by which the endless belt 12 is suspended and kept tensioned. The transfer belt 12 is circularly movable in the direction indicated by an arrow mark C in FIG. 12.

The photosensitive drum 4 in each of the cartridges P (PY, PM, PC and PK) is in contact with the top surface of the belt 12, by the downwardly facing portion of its peripheral surface. The area of contact between the photosensitive drum 4, and the belt 12, is the primary transfer station. There are disposed the primary transfer rollers 16 on the inward side of the loop which the transfer belt 12 forms, in such a manner that they are pressed against the photosensitive drums 4 one for one, with the presence of the belt 12 between them and photosensitive drums 4. Against the turn roller 14, the secondary transfer roller 17 is kept pressed, with the presence of the transfer belt 12 between the turn roller 14 and secondary transfer roller 17. The area of contact between the secondary transfer roller 17 and belt 12 is the secondary transfer station.

Referring also to FIG. 2, there is disposed a sheet feeding/conveying unit 18 below the intermediary transfer belt unit 11. This sheet feeding/conveying unit 18 has: a sheet feeder tray 19, in which multiple sheets S of recording medium are stored in layers; and a sheet feeder roller 20. There is disposed in the top left section of the apparatus main assembly 2, a fixation unit 21 and a discharge unit 22. A part of the top surface of the apparatus main assembly 2 is used as a delivery tray 23. To the sheet S of recording medium, a toner image is fixed by the fixing means with which the fixation unit 21 is provided. Then, the sheet S is discharged into the delivery tray 23.

Incidentally, the image forming apparatus 1 in the first embodiment is structured so that it forms an image with the use of the removably installable cartridge P which is equipped with the photosensitive drum 4, and the cleaning unit 8 having the charging means and cleaning means. However, the structure of the image forming apparatus 1 may be different from the one in this embodiment. For example, the image forming apparatus 1 may be structured so that its main assembly 2 is equipped with one or more photosensitive drums 4 and charging means, and also, so that it forms an image with the use of a removably installable cartridge (P) equipped with a cleaning unit having the cleaning means.

<<Image Forming Operation>>

Next, referring to FIGS. 2 and 3, the image forming operation of the image forming apparatus 1 in this embodiment is described. First, the photosensitive drum 4 in each of the first to fourth cartridges P (PY, PM, PC and PK) is rotationally driven at a preset speed in the counterclockwise direction in FIG. 2 (direction indicated by arrow mark D in FIG. 3(*b*)). The laser scanner unit LB also is driven. In synchronism with this driving of the laser scanner unit LB, the charge roller 5 in each cartridge P uniformly charges the peripheral surface of the photosensitive drum 4 to preset polarity and a preset potential level. The laser scanner unit LB scans (exposes) the peripheral surface of the photosensitive drum 4 with the beam Z of laser light it outputs while modulating the beam Z with the image formation signals which correspond one for one to the monochromatic toner images, different in color, into which the original has been separated. Consequently, an electrostatic latent image, which reflects the image formation signals of the corresponding color is formed on the peripheral surface of the photosensitive drum 4. The formed electrostatic latent image is developed by the development roller 6, which is being rotationally driven at a preset speed (clockwise direction in FIG. 2; direction indicated by arrow mark E in FIG. 3(*b*)).

Through the electrophotographic image formation process described above, a toner image of the yellow color, which corresponds to the yellow color component of the full-color image, is formed on the photosensitive drum 4 of the first cartridge PY. Then, the toner image is transferred (primary transfer) onto the transfer belt 12. Similarly, on the peripheral surface of the photosensitive drum 4 of the second cartridge PM, a toner image of the magenta color, which corresponds to the magenta color component of the full-color image, is formed. Then, the toner image of the magenta color is transferred (primary transfer) onto the transfer belt 12 in such a manner that it is laid upon the toner image of the yellow color, which has just been transferred (primary transfer) onto the transfer belt 12. Further, on the peripheral surface of the photosensitive drum 4 of the third cartridge PC, a toner image of the cyan color, which corresponds to the cyan color component of the full-color image, is formed. Then, the toner image is transferred (primary transfer) onto the transfer belt 12 in such a manner that it is laid upon the combination of the toner image of the yellow color, and the toner image of the magenta color, which have just been transferred (primary transfer) onto the transfer belt 12. Further, on the peripheral surface of the photosensitive drum 4 of the fourth cartridge PK, a toner image of the black color, which corresponds to the black color component of the full-color image, is formed. Then, the toner image is transferred (primary transfer) onto the transfer belt 12 in such a manner that it is laid upon the combination of the yellow, magenta, and cyan color images, which have just been transferred (primary transfer) onto the transfer belt 12.

Consequently, an unfixed full-color image is synthetically effected on the transfer belt 12, by the toner images of the yellow, magenta, cyan and black colors. Meanwhile, the sheets S of recording medium begin to be conveyed one by one while being separated from the rest with a preset control timing. Then, each sheet S is introduced into the secondary transfer station, which is the area of contact between the secondary transfer roller 17 and transfer belt 12 with a preset control timing. Thus, the four toner images, different in color, layered on the transfer belt 12 are transferred together onto the surface of the sheet S while the sheet S is conveyed through the secondary transfer station, as if they are peeled away from the transfer belt 12.

Thereafter, the sheet S of recording medium, onto which the toner images, different in color, have just been transferred, is conveyed to the fixation unit 21, in which it is subjected to pressure and heat. Thus, the toner images are fixed to the sheet S. After the fixation of the toner images, the sheet S is discharged into the delivery tray 23 by the discharge unit 22, ending thereby the image formation sequence described above.

<Structure of Cartridge>

Referring to FIG. 3(*a*), each of the cartridges P (PY, PM, PC and PK) is roughly in the form of a rectangle parallelepiped, the lengthwise direction of which is parallel to the direction of the rotational axis a of the photosensitive drum 4 (axial line direction). Each cartridge P has a cleaning unit 8, a development device 9, and a cover 24 on the drive side, and a cover 25 on the non-drive side.

<Structure of Cleaning Unit>

Figure 4:
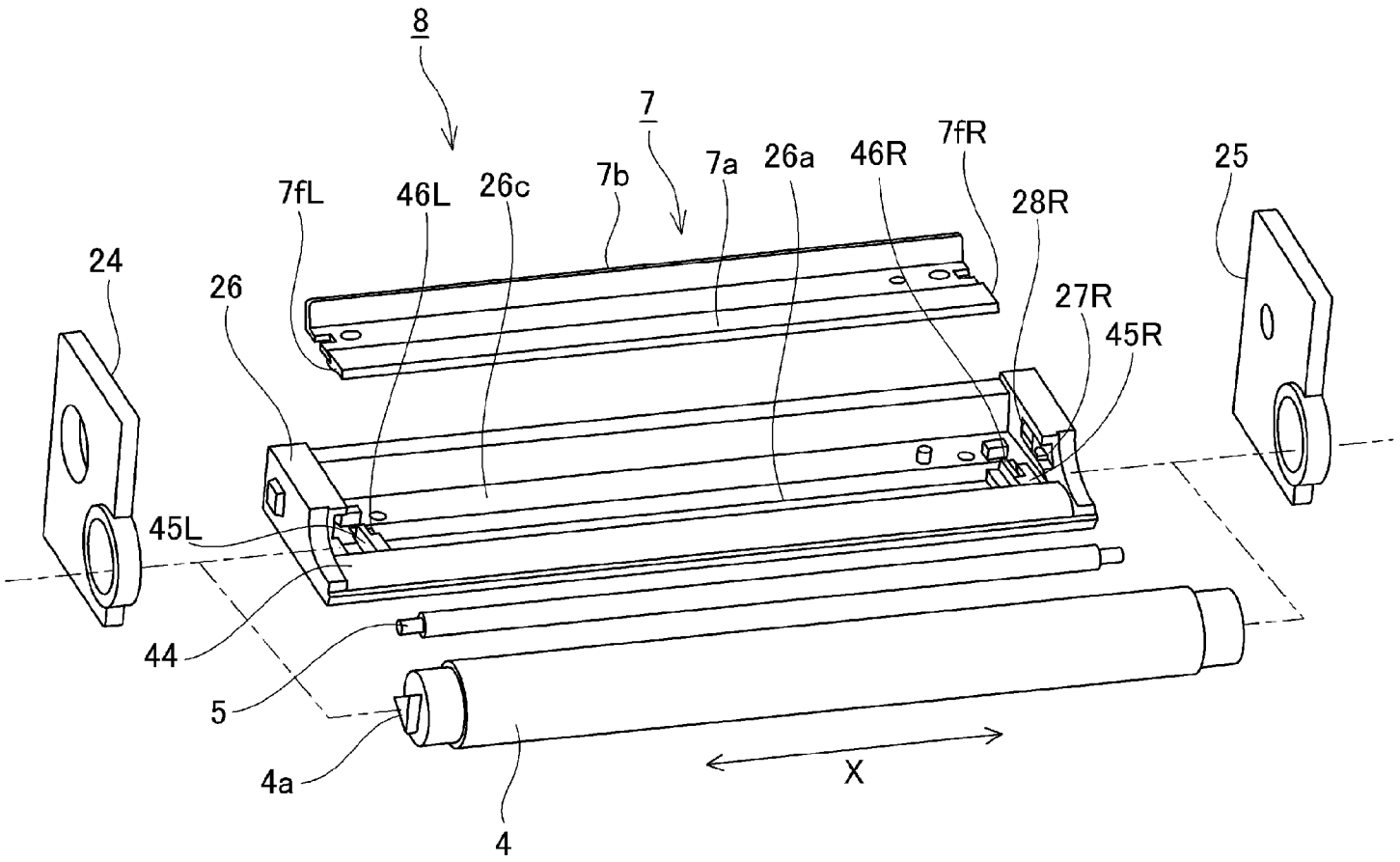
FIG. 4 is an exploded perspective view of the cleaning unit in the first embodiment.

Next, referring to FIGS. 3 and 4, the structure of the cleaning unit is described. FIG. 4 is an exploded perspective view of the cleaning unit in the first embodiment. Referring to FIG. 3(*b*), the cleaning unit 8 is made up of the photosensitive drum 4, charge roller 5, cleaning blade 7, and cleaning unit frame 26 which supports the photosensitive drum 4, charge roller 5, and cleaning blade 7.

Referring to FIG. 3(*a*), the photosensitive drum 4 is rotatably supported by the drive side cover 24 and non-drive side cover 25. It rotates (in direction indicated by arrow mark D in FIG. 3(*b*)) by obtaining the driving force of the motor (unshown) of the apparatus main assembly 2 through the drum drive coupling 4*a*.

Next, referring to FIG. 4, the charge roller 5 is rotatably supported by the pair of charge roller bearings 27R and 27L (unshown), on the non-drive and drive sides, respectively, of the cleaning unit frame 26, by its lengthwise end portions. It is kept in contact with the peripheral surface of the photosensitive drum 4, being thereby rotated by the rotation of the photosensitive drum 4. It charges the peripheral surface of the photosensitive drum 4 by being supplied with charge bias. In order to ensure that the peripheral surface of the photosensitive drum 4 is uniformly charged, the lengthwise ends of the charge roller 5 are pressed upon the peripheral surface of the photosensitive drum 4, by a pair of compression springs 28R and 28L (unshown), one for one.

The cleaning blade 7 is fixed to the blade supporting surface 26*c* of the cleaning unit frame 26, and is placed in contact with the peripheral surface of the photosensitive drum 4 by its cleaning edge, in such an attitude that its cleaning edge is placed in contact with the peripheral surface of the photosensitive drum 4 in the counter direction relative to the rotational direction (direction indicated by arrow mark D in FIG. 3(*b*)). The cleaning blade 7 cleans the peripheral surface of the photosensitive drum 4 by scraping away the transfer residual toner remaining on the peripheral surface of the photosensitive drum 4 (image bearing component) during image formation. In order to ensure that the transfer residual toner is completely scraped away, the cleaning edge of the cleaning blade 7 is kept pressed upon the peripheral surface of the photosensitive drum 4 with the application of a preset amount of pressure.

Further, the transfer residual toner scraped away from the peripheral surface of the photosensitive drum 4 by the cleaning blade 7 is stored as waste toner, in the waste toner storage 26*a* of the cleaning unit frame 26. Therefore, the cleaning unit frame 26 is provided with a waste toner recovery sheet 44, end seals 45R and 45L as the second seals, and elastic components 46R and 46L as the first seals, which are for preventing the waste toner from leaking out of the cleaning unit frame 26. It is not mandatory that the cleaning unit frame 26 is provided with the waste toner storage 26*a*. For example, the image forming apparatus 1 may be structured so that the cleaning unit 8 is provided with a mechanism for conveying the waste toner, to store the waste toner in the waste toner storage located outside the cleaning unit frame 26. The detailed structure of the waste toner seal is described later.

<Structure of Development Device>

Referring to FIG. 3(*b*), the development device 9 is in the form of a rectangular parallelepiped, the lengthwise direction of which is parallel to the direction of the rotational axis of the development roller 6 as a developer bearing member. The development device 9 has a development device frame 29, a development blade 31, and a developer supply roller 33, in addition to the development roller 6. The development device frame 29 has a toner storage 29*c* in which toner is stored, and an opening 29*c* through which toner is discharged from the toner storage 29*c*. The development roller 6 and developer supply roller 33 are positioned at the opening of the development frame 29, and the lengthwise ends of the development roller 6, and the lengthwise ends of the developer supply roller 33, are rotatably supported by the bearings (unshown) attached to the corresponding lateral walls of the development device frame 29.

The development blade unit 30 is a unit made up of a development blade 31, and a blade supporting metallic plate 32 to which the development blade 31 is fixed. The blade supporting metallic plate 33 is fixed to the development device frame 29 with small screws. The development blade 31 is a piece of thin and elastic metallic plate, which is roughly 0.1 mm in thickness. It is positioned in contact with the peripheral surface of the development roller 6 in the counter direction with reference to the rotational direction (indicated by arrow mark E in FIG. 3(*b*)).

The flexible sheet 35 is positioned so that it contacts the peripheral surface of the development roller 6, on the opposite side of the development device frame 29 from where the development blade 31 is in contact with the development roller 6. It prevents toner from leaking through the gap between the development device frame 29 and development roller 6.

The development device 9 is kept pressured by the compression springs (unshown) in such a direction that it is pivotally moved about the pivot (axial line b) shown in FIG. 3(*a*) in the direction (indicated by arrow mark G in FIG. 3(*b*)) to place the development roller 6 in contact with the photosensitive drum 4. When an image is formed, the developer supply roller 33 and development roller 6 are rotationally driven while rubbing against each other. Thus, the toner is borne on the development roller 6. The development blade 31 regulates in thickness the toner layer formed on the peripheral surface of the development roller 6, and also, gives toner triboelectric charge in the area of contact between itself and development roller 6, by being kept pressed upon the development roller 6. Thus, the charged toner on the development roller 6 adhere to the electrostatic latent image on the photosensitive drum 4, developing thereby the latent image, in the area of contact between the development roller 6 and photosensitive drum 4.

<Detailed Structure of Cleaning Blade>

Figure 5:
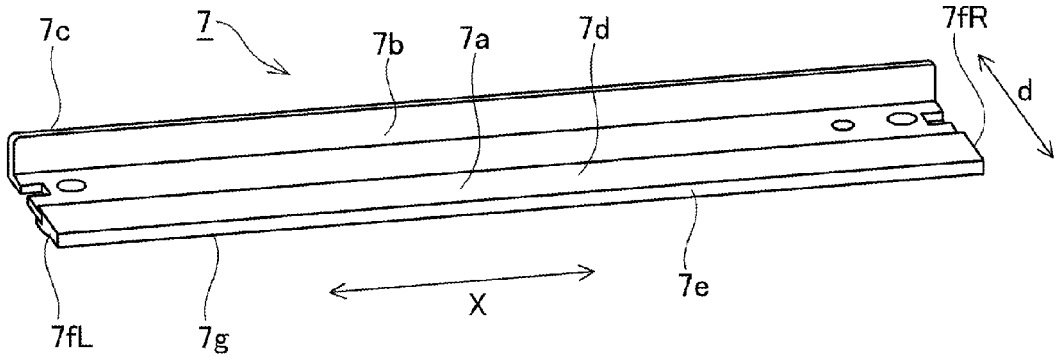
FIG. 5 is a drawing of the cleaning blade in the first embodiment.
Figure 5:
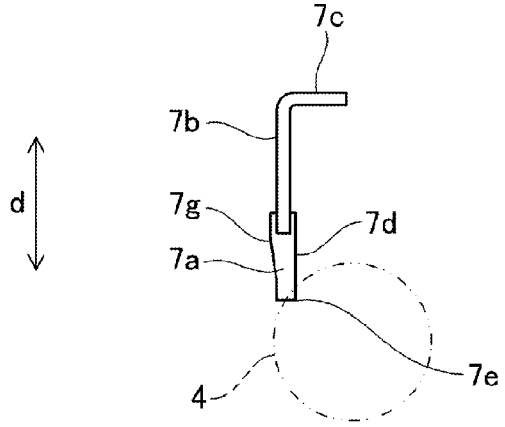

Next, referring to FIG. 5, the structure of the cleaning blade in the first embodiment is described. FIG. 5(*a*) is an external perspective view of the cleaning blade in this embodiment, and FIG. 5(*b*) is a schematic sectional view of the cleaning blade 7 in the first embodiment. The two-dot chain line in FIG. 5(*b*) shows the contour of the photosensitive drum 4.

Referring to FIGS. 5(*a*) and 5(*b*), the cleaning blade 7 has an elastic blade section 7*a*, and a support section 7*b* which supports the elastic blade section 7*a*. Hereafter, various sections of the cleaning blade 7 are referred to as follows: The surface of the cleaning blade 7, by which the blade 7 contacts the photosensitive drum 4 is referred to as the top surface 7*d*. The side of the cleaning blade 7, in terms of the widthwise direction of the cleaning blade 7, by which the blade section 7*a* contacts the photosensitive drum 4 is referred to as the edge side. The surface of the cleaning blade 7, which is on the edge side, and is perpendicular to the top surface 7*d*, is referred to as the end surface 7*e*. The surfaces of the cleaning blade 7, which are at the lengthwise ends of the cleaning blade 7, one for one, and are perpendicular to the top surface 7*d*, are referred to as the lengthwise end surfaces 7*f*R and 7*f*L. The surface of the cleaning blade 7, which are the opposite surface from the top surface 7*d*, and which the elastic components 46R and 46L contact, is referred to as bottom surface 7*g*. Further, the direction which is parallel to the top surface 7*d* and perpendicular to the lengthwise direction is referred to as the widthwise direction (indicated by arrow mark d in FIGS. 5(*a*) and 5(*b*)).

The blade section 7*a* is made of an elastic substance, and contacts the photosensitive drum 4. It is fixed to the blade support section 7*b* with adhesive, or the blade support section 7*b* is formed as an integral part of the blade section 7*a*. The elastic blade section 7*a* removes the transfer residual toner from the photosensitive drum 4 by being placed in contact with the photosensitive drum 4, by this edge side, in such a manner that its extends from one lengthwise end of the photosensitive drum 4 to the other. As the material for the elastic blade section 7*a*, natural rubber, and synthetic rubber such as urethane rubber, can be listed.

The support section 7*b* is formed of steel plate (made of iron, for example) which is 0.5-2.0 mm in thickness. It is fixed to the blade supporting surface 26*c* (FIG. 4) of the cleaning unit frame 26. Further, in order to minimize the deformation of the cleaning blade 7 in the direction perpendicular to the lengthwise direction, the support section 7*b* is provided with a sub-section 7*c* which is perpendicular to the lengthwise direction of the cleaning blade 7, to increase the cleaning blade 7 in rigidity. However, if the support section 7*b* is rigid enough to resist the force which works in the direction to deform the support section 7*b*, the sub-section 7*c* is unnecessary. For example, the support section 7*b* may be increased in rigidity by increasing it in thickness, and/or using a stronger substance such as stainless steel, as the material for the support section 7*b*.

<Detail of Structure of End Seal>

Figure 6:
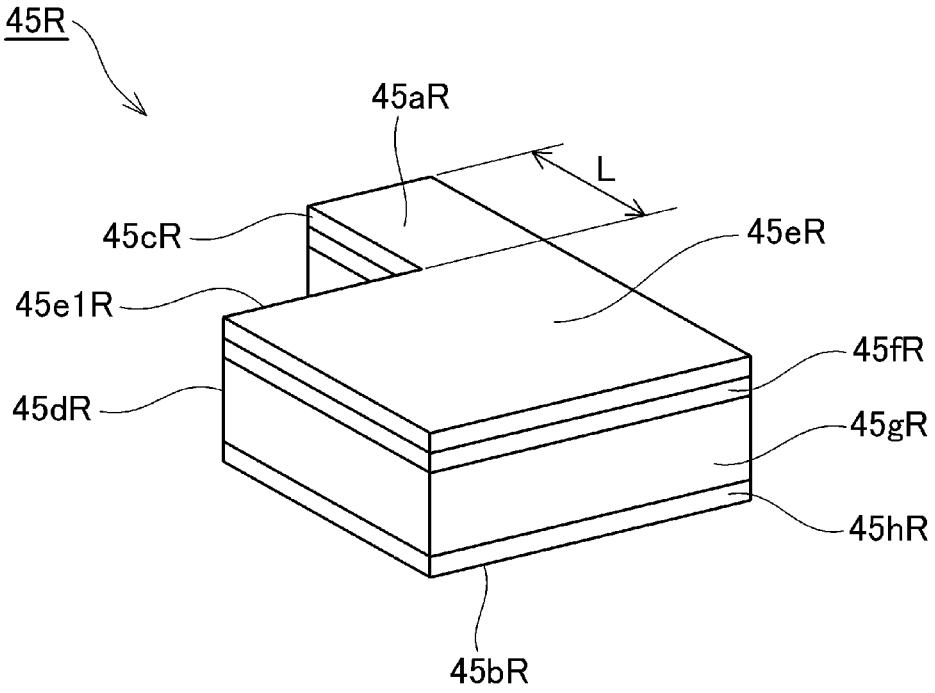
FIG. 6 is an external perspective view of the end seal in the first embodiment.

Next, referring to FIG. 6, the structure of the end seal as the second seal in the first embodiment is described. Referring to FIG. 6, in the first embodiment, the end seal 45R is roughly L-shaped in cross section, and has a protrusive portion 45*a*R which protrudes by a length L from the main section of the end seal 45R. The end seal 45R is made up of a surface layer 45*e*R, an adhesive layer 45*f*R, an intermediary layer 45*g*R, and an adhesive layer 45*h*R. That is, the end seal 45R is shaped so that as it is attached to the cleaning unit, the protrusive portion 45*a*R extends outward of the cleaning unit 8 beyond the lengthwise end surface 7*f*R in the lengthwise direction, and extends further from the cleaning edge of the cleaning blade 7 toward the base side of the cleaning blade 7. Providing the end seal 45R with the protrusive portion 45*a*R makes it possible to prevent the waste toner from leaking from the cleaning unit frame 26. FIG. 6 shows only an example of the structure of the end seal 45. That is, the dimension L of the protrusive portion 45*a* may be less than the one shown in FIG. 6. Further, as long as the sealing edge of the cleaning blade 7 is satisfactory in terms of sealing performance, it is not mandatory that the end seal 45R is provided with the protrusive portion 45*a*.

The surface layer 45*e*R is made up of a substrative cloth and multiple upright strands of fiber which are implanted in the substrative cloth. However, the surface layer 45*e*R may be made up of the substrative cloth alone. The surface layer 45*e*R is attached to the surface of the intermediary layer 45*g*R with the placement of the adhesive layer 45*f*R, for example, a piece of two-sided adhesive tape, a layer of adhesive, or the like, between the surface layer 45*e*R and intermediary layer 45*g*R. The material for the substrative cloth may be a piece of cloth woven of warp and weft, a piece of cloth knitted of thread, a piece of nonwoven cloth made by joining strands of fiber, and the like. As for the method for making nonwoven cloth, there are the method for joining strands of fiber by blowing heated steam at the strands, method for joining strands of fiber by thermally melting the strands, method for making strands of fiber entangle by highly pressurized streams of water, and the like. As for the type of pile, the strands may be in the form of a loop, or multiple upright strands. Further, in a case where the end seal 45 is formed of the substrative cloth alone, strands of fiber may be electrostatically implanted upright on the surface of the substrative cloth.

As the material for the surface layer 45*e*R, synthetic fiber made of polyethylene, polypropylene, polyester, Nylon, acrylic resin, polyethylene-terephthalate, or the like, semi-synthetic fiber made of rayon or the like, natural fiber such as cotton, may be used. Further, the combination of the preceding materials, and the twined version of the preceding fibers, may also be listed as the material for the strands. Further, the surface layer 45*e*R may be coated with lubricant such as silicone resin, zinc stearate. That is, the material for the surface layer 45*e*R may be those other than the above listed ones, as long as they are excellent in heat resistance, durability, and friction resistance, and are satisfactory in the strength of their adhesion to the adhesive layer 45*f*R.

The intermediary layer 45*g*R is a cushion layer formed of an elastic substance. As the material for the intermediary layer 45*g*R, a foamed version of synthetic resin such as polyurethane, and also, synthetic rubber, natural rubber, thermoplastic elastomer, etc, may be used. The material for the intermediary layer 45*g*R may be other substances than the above listed ones, as long as they are excellent in heat resistance and durability, and satisfactory in the strength of adhesion to the adhesive layer 45*h*R.

The adhesive layer 45*h*R is on the back surface of the intermediary layer 45*g*R, and is formed of two-sided adhesive tape, pressure sensitive adhesive, or the like. The surface of the adhesive layer 45*h*R, by which the adhesive layer 45*h*R is adhered to the development device frame 29, will be referred to as the adhesion surface 45*b*R. The material for the adhesive layer 45*h*R may be other material than the abovementioned ones, as long as it allows the adhesive layer 45*h*R to be flexible and is adherent enough to ensure that the adhesive layer 45*h*R remains adhered to the intermediary layer 45*g*R and development device frame 29.

The end seal 45R in the first embodiment, which is made up of four layers, that is, the surface layer 45*e*R, adhesive layer 45*f*R, intermediary layer 45*g*R, and adhesion layer 45*h*R, is an example of the end seal 45 which is in accordance with the present invention. However, the end seal 45R may be made up of only two layers, that is, the surface layer 45*e*R and adhesive layer 45*h*R. In such a case, the surface layer 45*e*R has to be given a certain amount of thickness, with the use of nonwoven cloth as the material for the substrative cloth 45*e*R. Incidentally, the end seal 45L (FIG. 4) is symmetrically shaped relative to the end seal 45R, and the same in structure as the end seal 45R. Therefore, it is not described.

<Structural Arrangement for Keeping Waste Toner Storage Sealed>

Next, referring to FIG. 4, the structural arrangement for keeping the waste toner storage sealed is described. In order to prevent the waste toner stored in the waste toner storage 26*a* of the cleaning unit frame 26 from leaking, the cleaning unit frame 26 is provided with the waste toner recovery sheet 44, pair of end seals 45R and 45L as the second seals, and pair of elastic components 46R and 46L as the first sealing components.

The waste toner recovery sheet 44 is a flexible sheet which prevents the waste toner from leaking through the gap between the cleaning unit frame 26 and photosensitive drum 4 in terms of the widthwise direction. The waste toner recovery sheet 44 is disposed so that it contacts the peripheral surface of the photosensitive drum 4, on the opposite side of the cleaning unit frame 26, from where the cleaning blade 7 contacts the photosensitive drum 4.

Figure 7:
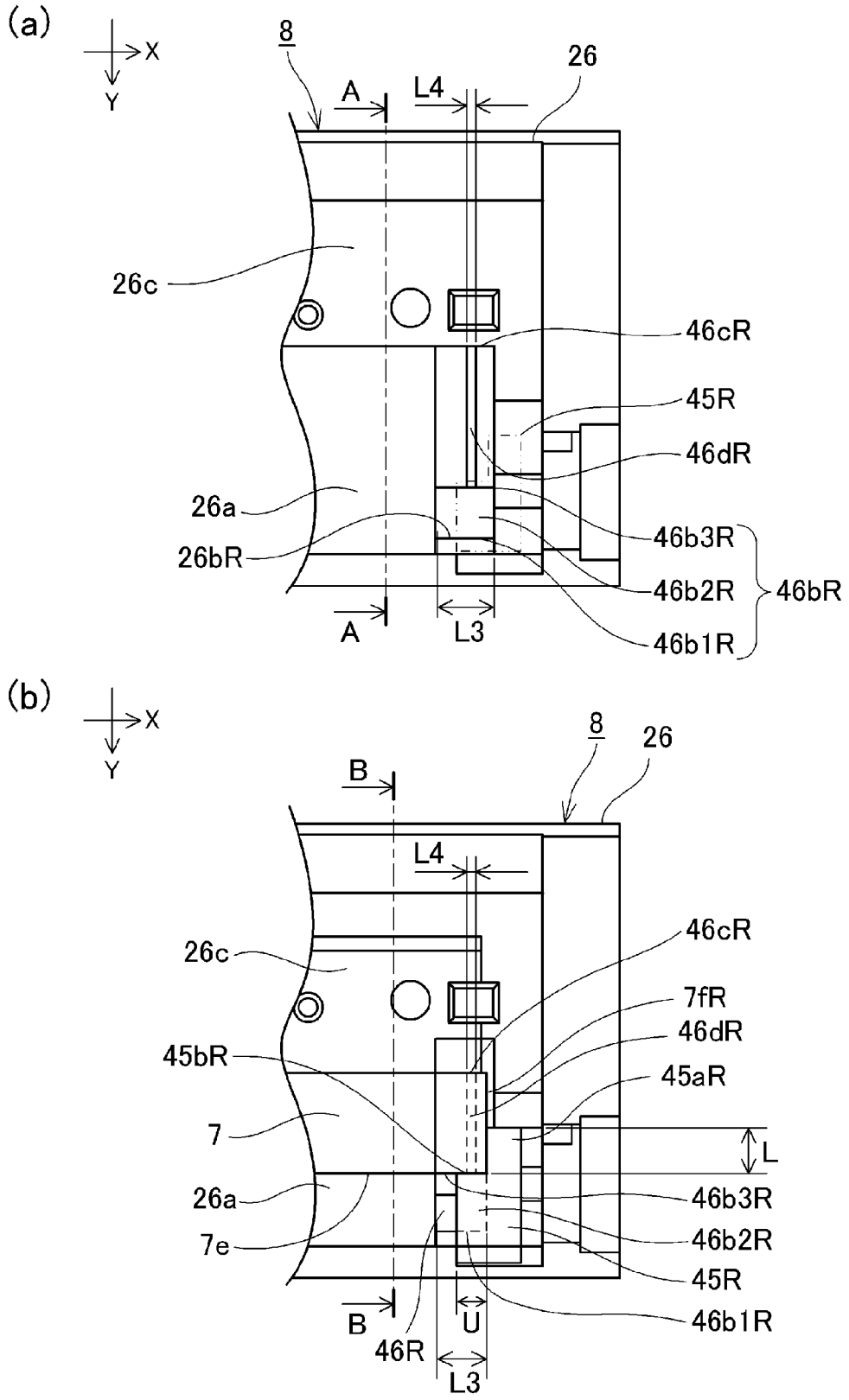
FIG. 7 is schematic drawing of the right end seal, and its adjacencies, and shows how the lengthwise ends of the cleaning unit are kept sealed.
Figure 8:
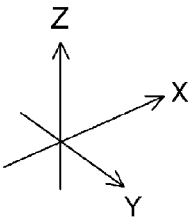
FIG. 8 is a perspective view of the right elastic component and its adjacencies of the cleaning unit in the first embodiment.
Figure 8:
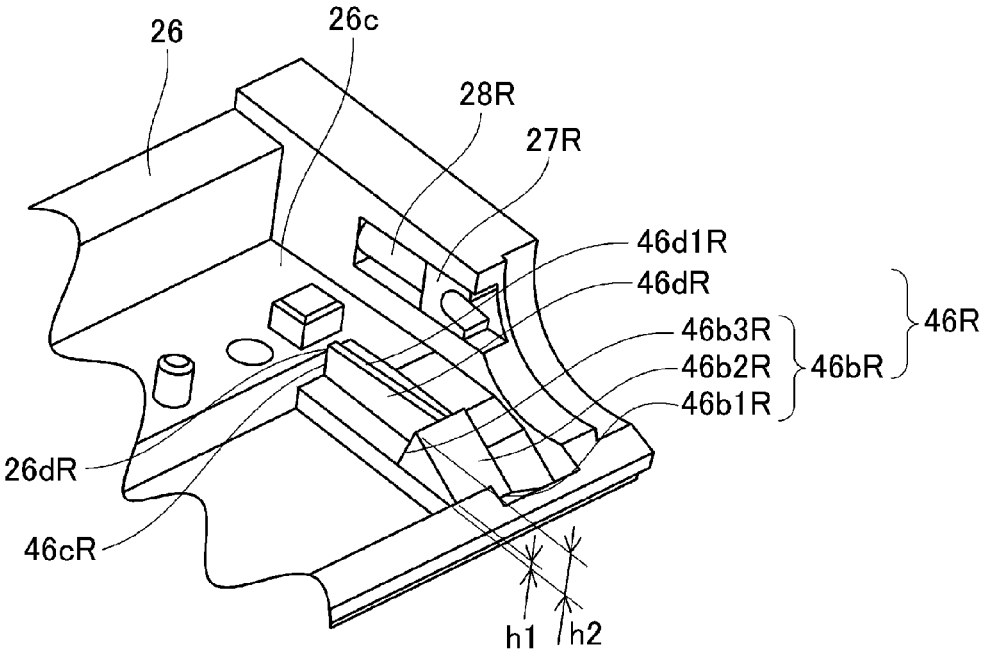

Next, referring to FIGS. 4, 7 and 8, the elastic components 46R and 46L are described. FIG. 7(*a*) is a drawing which shows the state of the right end of the cleaning blade 7 and its adjacencies, after the elastic component 46R was formed in the cleaning unit frame 26 by injection molding, and before the cleaning blade 7 and end seal 45R are attached to the cleaning unit frame 26. FIG. 7(*b*) is a drawing which shows the state of the right end of the cleaning blade 7 and its adjacencies. It shows the structural arrangement for keeping the cleaning unit frame 26 sealed at the lengthwise right end of the cleaning unit frame 26. Referring to FIG. 7(*a*), the portion of the cleaning unit frame 26, to which the end seal 45R is attached is indicated by a two-dot chain line. Incidentally, the elastic components 46R and 46L are the same in shape, although they are symmetrically positioned relative to each other. Therefore, only the elastic component 46R, which is on the non-driven side is described.

In the first embodiment, the elastic component 46R is formed of resinous material, more specifically, thermoplastic elastomer. It is formed by injection molding, which is a method for molding a component by injecting melted resin into a gap formed by affixing a mold to the cleaning unit frame 26. Referring to FIG. 7(*b*), the elastic component 46R is positioned 0-10 mm away toward the center of the cleaning blade 7, from the lengthwise end surface 7*f*R of the cleaning blade 7. Further, referring to FIG. 7(*a*), the elastic component 46R has a cleaning blade contacting vertical section 46*d*R (which may be referred to simply as vertical sealing section), and an end seal attachment section (which may be referred to simply as bearing section) 46*b*R to which the end seal 45R is attached. The vertical seal section 45*d*R of the elastic component 46R prevents the waste toner from leaking through the gaps which are present between the lengthwise ends of the cleaning blade 7 and the corresponding lengthwise ends of the cleaning unit frame 26. The detail of the shape of the elastic component 46R is described later.

The end seals 45R and 45L are disposed in contact with the elastic components 46R and 45L, remaining compressed by the photosensitive drum 4 and cleaning unit frame 26, at the lengthwise ends of the cleaning blade 7. The end seal 45R prevents the waste toner from leaking through the gaps created by the cleaning blade 7, photosensitive drum 4, elastic component 45R, and cleaning unit frame 26.

Figure 1:
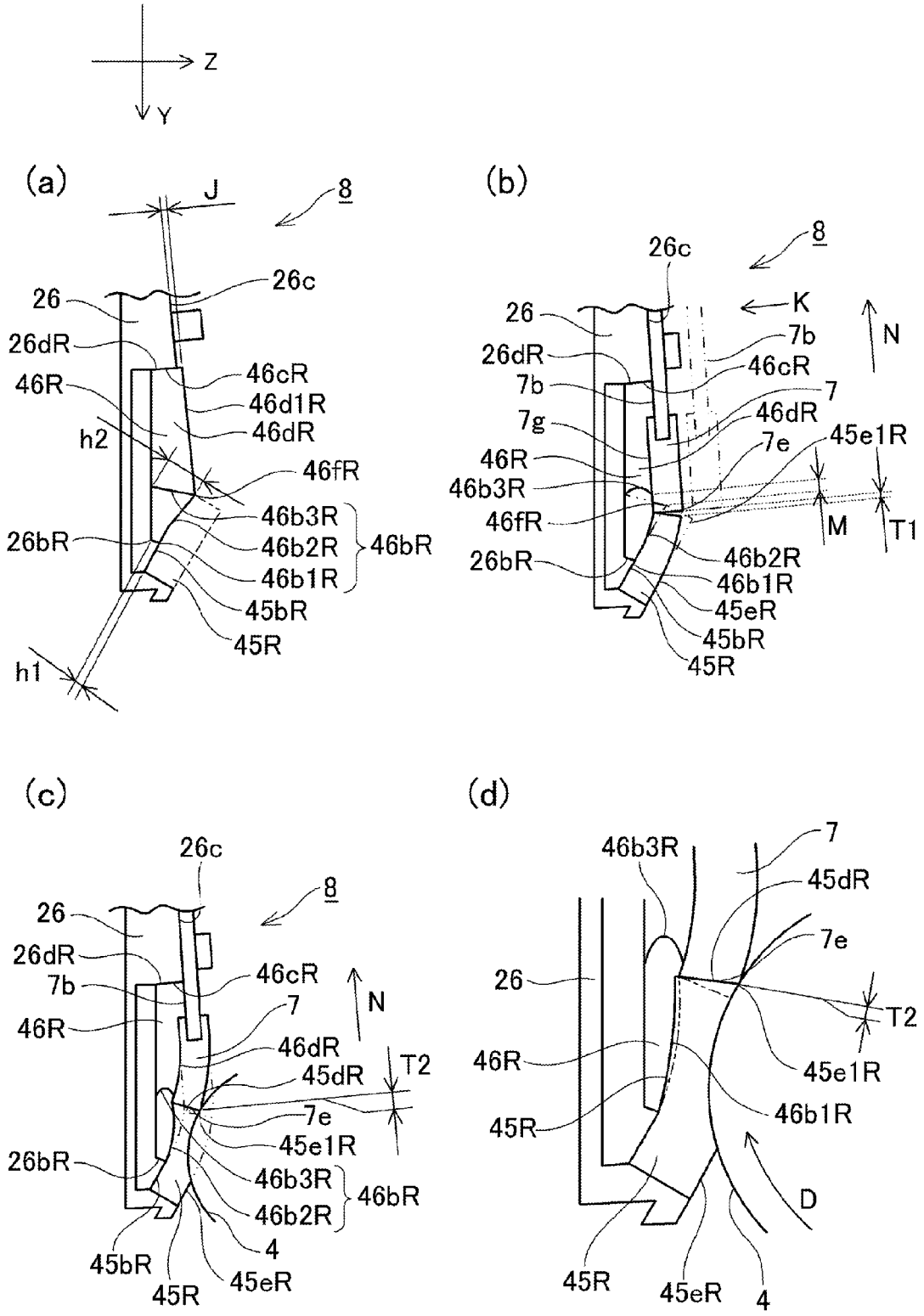
FIG. 1 is a drawing for showing the structural arrangement for keeping sealed the toner (developer) in the cleaning unit in the first embodiment of the present invention.

Next, referring to FIGS. 1, 7 and 8, the sequential steps through which the abovementioned components are assembled to prevent the waste toner from leaking from the gaps which are present at the lengthwise ends of the cleaning blade 7 are described. Here, the steps are described with reference to the non-drive side of the cleaning unit. FIG. 1(*a*) is a schematic sectional view of the right end seal 45R and its adjacencies, at a plane A-A in FIG. 7(*a*). FIG. 1(*b*) is a schematic sectional view of the right end seal 45R, at a plane B-B in FIG. 7(*b*). It shows the state of the right end seal 45R after the cleaning blade 7 was attached to the cleaning unit frame 26. FIG. 1(*c*) is a schematic sectional view of the right end seal 45R, at a plane B-B in FIG. 7(*b*). It shows the state of the end seal 45R after the photosensitive drum 4 was attached to the cleaning unit frame 26. FIG. 1(*d*) is an enlarged view of the right end seal 45R and its adjacencies shown in FIG. 1(*c*). FIG. 8 is a perspective view of the elastic component 46R and its adjacencies, after the attachment of the elastic component 46R to the cleaning unit frame 26. Hereafter, the lengthwise and widthwise directions of the cleaning unit frame 26 will be referred to as directions X and Y, respectively, and the direction perpendicular to the directions X and Y will be referred to as the direction Z (directions indicated by arrow marks X, Y, and Z are their positive directions).

<Injection Molding of Elastic Component, and Shape of Elastic Component>

First, the elastic component 46R is formed by injection molding. Referring to FIG. 8, the elastic component 46R is in the form of a T-shaped rib, the horizontal and vertical sections of which are parallel to the directions Y and X, respectively. It has the vertical sealing section 46*d*R for sealing the gap between the cleaning blade 7 and cleaning unit frame 26, and an end seal bearing deformable section 46*b*R, to which the end seal 45R is pasted. Next, referring to FIG. 7(*b*), the width L3 of the end seal bearing section 46*b*R is greater than the width L4 of the vertical sealing section 46*d*R.

Next, referring to FIGS. 8 and 1(*a*), the end seal bearing section 46*b*R of the elastic component 46R, which is the end portion of the elastic component 46R in terms of the direction Y, has the top surface 46*b*1R, a contacting surface 46*b*2R, and a proximity surface 46*b*3R. The top surface 46*b*1R is airtightly in contact with the elastic component contacting front section 26*b*R of the cleaning unit frame 26. The contacting surface 46*b*2R is in contact with the adhesion surface 45*b*R of the end seal 45R. The proximity surface 46*b*3R is parallel to the direction −Y, and is next to the vertical sealing section 46*d*R.

The state in which the end seal bearing section 46*b*R of the elastic component 46R was before its deformation is shown in FIG. 1(*a*). The end seal bearing section 46*b*R is roughly in the form of a trapezoid, being shaped so that its contacting surface 46*b*2R is tilted in such a direction that the thickness of the end seal bearing section 46*b*R in terms of the direction Z gradually increases from the top surface side, at which it is h1, toward the proximity surface side, at which it is h2. That is, the closer to the end surface 7*e* of the cleaning blade 7, the thicker the end seal bearing section 46*b*R. Referring to FIG. 1(*a*), the elastic component 46R is formed by injection molding so that the rear end surface 46*c*R of the elastic component 46R in terms of the direction −Y airtightly contacts with the elastic component contacting rear section 26*d*R of the cleaning unit frame 26, and also, so that in terms of the direction Z, the top surface 46*d*1R of the vertical sealing section 46*d*R will be above the cleaning blade supporting surface 26*c* of the cleaning unit frame 26 by a distance J.

<Pasting of End Seal>

Referring to FIG. 7(*b*), etc., the end seal 45R is placed on the seal contacting surface 46*b*2R of the elastic component 46R. The width of the area of contact between the elastic component 46R and end seal 45R is U.

<Attachment of Cleaning Blade>

Next, the steps through which the cleaning blade 7 is attached to the cleaning unit frame 26 are described following the sequence in which they are performed. Referring to FIG. 1(*b*), the two-dot chain lines indicate the contours of the cleaning blade 7 and end seal 45R immediately before the cleaning blade 7 and end seal 45R are attached to the cleaning unit frame 26. The cleaning blade 7 is attached to the cleaning unit frame 26 in the direction indicated by an arrow mark K in FIG. 1(*b*) so that it overlaps with the adhesion surface 45*b*R of the end seal 45R in terms of the direction Y. At this point, there is a gap T1 between the top edge 45*e*1R of the surface layer 45*e*R of the end seal 45, and the end surface 7*e* of the cleaning blade 7.

<Sealing of Gap Between Cleaning Blade and Vertical Sealing Section of Elastic Component>

Referring to FIG. 1(*a*), the elastic component 46 is formed by injection molding in such a shape and a size that after the assembly of cleaning unit, the top surface 46*d*1R of the vertical sealing section 46*d*R of the elastic component 46 is above the cleaning blade supporting surface 26*c* in terms of the direction Z. Therefore, the vertical sealing section 46*d*R comes into contact with the bottom surface 7*g* and support section 7*b* of the cleaning blade 7, and is squashed (compressed) by them.

At this time, how the area of contact between the cleaning blade 7 and the vertical sealing section 46*d*R is sealed is described. The elastic component 46R is made of an elastic substance. Therefore, as the cleaning blade 7 is attached to the cleaning unit frame 26, the elastic component 46R is deformed by the cleaning blade 7 in such a manner that it conforms in shape to both the bottom surface 7*g* and support section 7*b* of the cleaning blade 7. Therefore, no gap is created between the cleaning blade 7 and the vertical sealing section 46*d*R. Further, the elastic component 46R made of thermoplastic elastomer is sticky, and therefore, it airtightly contacts (sticks to) the cleaning blade 7. In other words, the area of contact between the elastic component 46R and cleaning blade 7 remains airtightly sealed. Therefore, it is possible to reduce the width L4 of the vertical sealing section 46*d*R of the elastic component 46R as shown in FIG. 7.

Next, how the area of contact between the cleaning blade 7 and end seal 45R is sealed is described. Referring to FIG. 1(*b*), the end seal 45R is pressed by the cleaning blade 7. As it is pressed, the end seal bearing section 46*b*R of the elastic component 46R, which is deformable, is subjected, through the end seal 45R, to the force generated in the direction K as the cleaning blade 7 is moved in the direction K to be attached to the cleaning unit frame 26.

Referring to FIG. 7, the width L4 of the vertical sealing section 46*d*R, which is adjacent to the end seal bearing section 46*b*R, is less than the width L3 of the end seal bearing section 46*b*R. Therefore, there is provided a space for allowing the end seal bearing section 46*b*R to extend in the direction Y, which is parallel to the proximity surface 46*b*3R of the elastic component 46R, as the end seal bearing section 46*b*R is compressed. Thus, as the elastic component 46R is compressed by the cleaning blade 7, the end seal bearing section 46*b*R of the elastic component 46R substantially extends into the abovementioned space in the direction parallel to the proximity surface 46*b*3R. Consequently, the proximity surface 46*b*3R of the elastic component 46R, and the ridge (intersection) 46*f*R between the proximity surface 46*b*3R and contacting surface 46*b*2R is moved by a distance M in the direction indicated by an arrow mark N, due to the deformation of the elastic component 46R. Therefore, the end seal 45R attached to the end seal bearing section 46*b*R of the elastic component 46R is moved by a distance M in the direction indicated by the arrow mark N by the deformation of the elastic component 46R as shown in FIG. 1(*b*), being thereby positioned close to the cleaning edge 7*e* of the cleaning blade 7. That is, the gap T1 between the end surface 7*e* of the cleaning blade 7 and the ridge 45*e*1R of the surface layer 45*e*R of the end seal 45R is reduced.

FIG. 1(*c*) shows the state in which the end seal 45R, elastic component 46R, cleaning blade 7, and photosensitive drum 4 are immediately after the attachment of the photosensitive drum 4 to the cleaning unit frame 26. The two-dot chain line in FIG. 1(*c*) indicates the contour of the cleaning blade 7 and end seal 45R before the attachment of the photosensitive drum 4 to the cleaning unit frame 26. The blade contacting portion (surface) 45*d*R of the end seal 45R is in contact with the end surface 7*e* of the cleaning blade 7, and the surface layer 45*e*R is in contact with the photosensitive drum 4. As the photosensitive drum 4 is attached to the cleaning unit frame 26, the end seal bearing section 46*b*R of the elastic component 46R is compressed, through the end seal 45R, by the photosensitive drum 4, being thereby deformed. Consequently, it is moved in the direction indicated by the arrow mark N. Thus, the gap T1 between the end surface 7*e* of the cleaning blade 7 and the ridge 45*e*1R of the surface layer 45*e*R, reduces to a gap T2. Further, the end surface 7*e* comes into contact with the end seal 45R. As described above, the end seal 45R seals the gap created by the end seal 45R, cleaning blade 7, photosensitive drum 4, and cleaning unit frame 26, in terms of the lengthwise direction, improving thereby the cleaning unit in terms of the prevention of the waste toner leakage.

FIG. 1(*d*) shows in detail the state of the end surface 7*e* of the cleaning blade 7, and its adjacencies, while the photosensitive drum 4 is rotated. The two-dot chain line in FIG. 1(*d*) indicated the contour of the end seal 45R before the photosensitive drum 4 begins to be rotated. The photosensitive drum 4 rotates in the direction indicated by an arrow mark D. The end surface 7*e* of the cleaning blade 7 is deformed by the friction between the cleaning blade 7 and photosensitive drum 4, being thereby shifted downstream in terms of the rotational direction of the photosensitive drum 4. The rotational force of the photosensitive drum 4 is applied by the friction between the end seal 45R and photosensitive drum 4, to the end seal 45R, which is on the upstream side of the end surface 7*e* of the cleaning blade 7 in terms of the rotational direction of the photosensitive drum 4 in the area in which the residual toner is removed from the photosensitive drum 4. Thus, the end seal 45R is moved by the friction in the direction indicated by the arrow mark D.

The end seal 45R is compressed also in the circumferential direction of the photosensitive drum 4 by the cleaning blade 7 and photosensitive drum 4. Therefore, the end seal 45R extends in the direction indicated by the arrow mark D, following the movement of the end surface 7*e* of the cleaning blade 7. Further, the adhesion surface 45*b*R of the end seal 45R and the top surface 45*b*1R of the end seal 45R is moved in the direction indicated by the arrow mark D by the force applied to the end seal 45R. Thus, the end seal 45R extends along the end surface 7*e* of the cleaning blade 7, preventing thereby the gap T2 from increasing. Further, as the photosensitive drum 4 rotates, the end seal 45R, which is remaining compressed, expands (extends), ensuring that the surface of the end seal 45R, which is parallel to the direction +Y, remains in contact with the cleaning unit frame 26.

Regarding the prevention of the waste toner leakage, the cleaning unit can be improved by reducing the gap between the cleaning blade 7 and end seal 45R. However, if the distance between the portion of the elastic component 46R, to which the end seal 45R is adhered, and the end surface 7*e* of the cleaning blade 7, is simply reduced, it becomes likely for the cleaning blade 7 to run onto the surface layer 45*e*R of the end seal 45R when the cleaning blade 7 is attached. As the cleaning blade 7 runs onto the surface layer 45*e*R, a gap is created between the photosensitive drum 4 and end seal 45R. This gap allows the waste toner to pass between the photosensitive drum 4 and end seal 45R, and leaks from the cleaning unit 8.

In the first embodiment, the end seal bearing section 46*b*R of the elastic component 46R, which has the surface to which the end seal 45R is pasted, is deformable by the attachment of the cleaning blade 7. Therefore, as the elastic component 46R is compressively deformed between the photosensitive drum 4 and cleaning unit frame 26, it can reduce the gap T between the cleaning blade 7 and end seal 45R. Thus, the first embodiment can make it possible to better seal the cleaning unit 8 to prevent the waste toner from leaking, without reducing the cleaning unit 8 in assembly efficiency.

Also in the first embodiment, the elastic component 46R is made of thermoplastic elastomer, by injection molding, so that the end seal bearing section 46*b*R having the surface to which the end seal 45R is adhered, will be formed of thermoplastic elastomer. With the use of thermoplastic elastomer as the material for the elastic component 46R, the gap T between the cleaning blade 7 and end seal 45R can be reduced by the attachment of the cleaning blade 7 and photosensitive drum 4 to the cleaning unit frame 26. Therefore, the cleaning unit 8 in this embodiment is superior in terms of the prevention of the waste toner leakage. Therefore, even if the protrusive portion 45*a*R of the end seal 45R is reduced in its length L, the waste toner remains satisfactorily sealed in the cleaning unit 8. That is, according to the first embodiment of the present invention, it is possible to reduce the end seal 45R in size, reducing thereby the cost.

Further, there is virtually no difference between the cost of thermoplastic elastomer as the material for the end seal 45R and the cost of foamed version of synthetic resin, which has been widely used as the material for the elastic component 46R. Therefore, the elastic component 46R in the first embodiment is no higher in cost than any of the conventional elastic components, making it possible to reduce the cleaning unit 8 in cost. Incidentally, the structural arrangement for keeping the cleaning unit 8 sealed at the lengthwise end on the drive side, to prevent the waste toner leakage, is the same as the structural arrangement for keeping the cleaning unit 8 sealed at the lengthwise end on the non-drive side to prevent the waste toner leakage. Therefore, it is not described.

As described above, in the first embodiment, the elastic component which is to be placed, in the compressed state, between the cleaning blade and cleaning unit frame of the cleaning unit, for removing the transfer residual toner remaining on the photosensitive drum, is formed of thermoplastic elastomer, by injection molding. Thus, the elastic component is capable of remaining airtightly in contact with the end seal, by its end seal bearing deformable section. Further, as it is compressed by the photosensitive drum, the seal bearing section deforms in such a manner that it moves the end seal closer to the cleaning edge of the cleaning blade, improving thereby the cleaning unit in terms of the prevention of the waste toner leakage. The cleaning unit in the first embodiment is for removing the transfer residual toner remaining on the photosensitive drum. However, the present invention is also applicable to a cleaning unit for removing the transfer residual toner remaining on the intermediary transfer belt 12 (FIG. 2) of the image forming apparatus.

Embodiment 2

Figure 9:
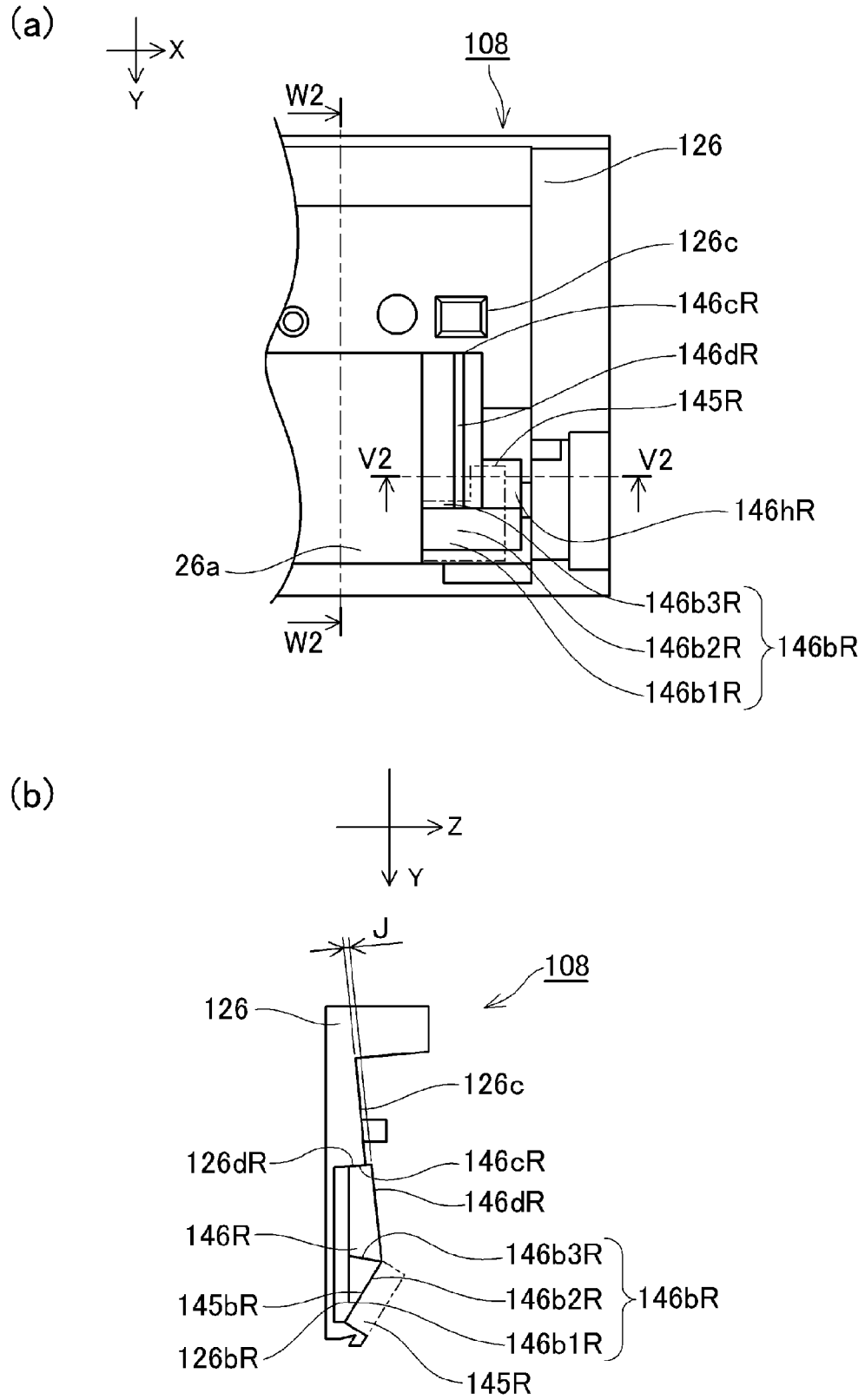
FIG. 9 is a drawing which shows how the lengthwise right end portion of the cleaning unit is sealed in the second embodiment.
Figure 10:
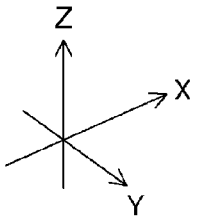
FIG. 10 is a perspective view of the right elastic component and its adjacencies of the cleaning unit in the second embodiment.
Figure 10:
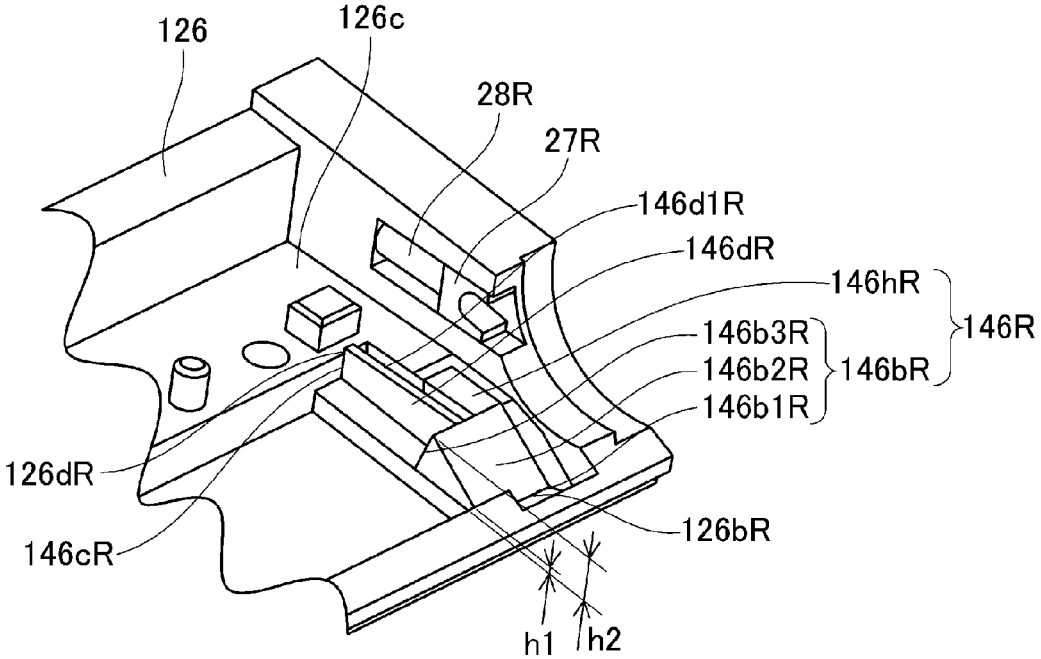
Figure 11:
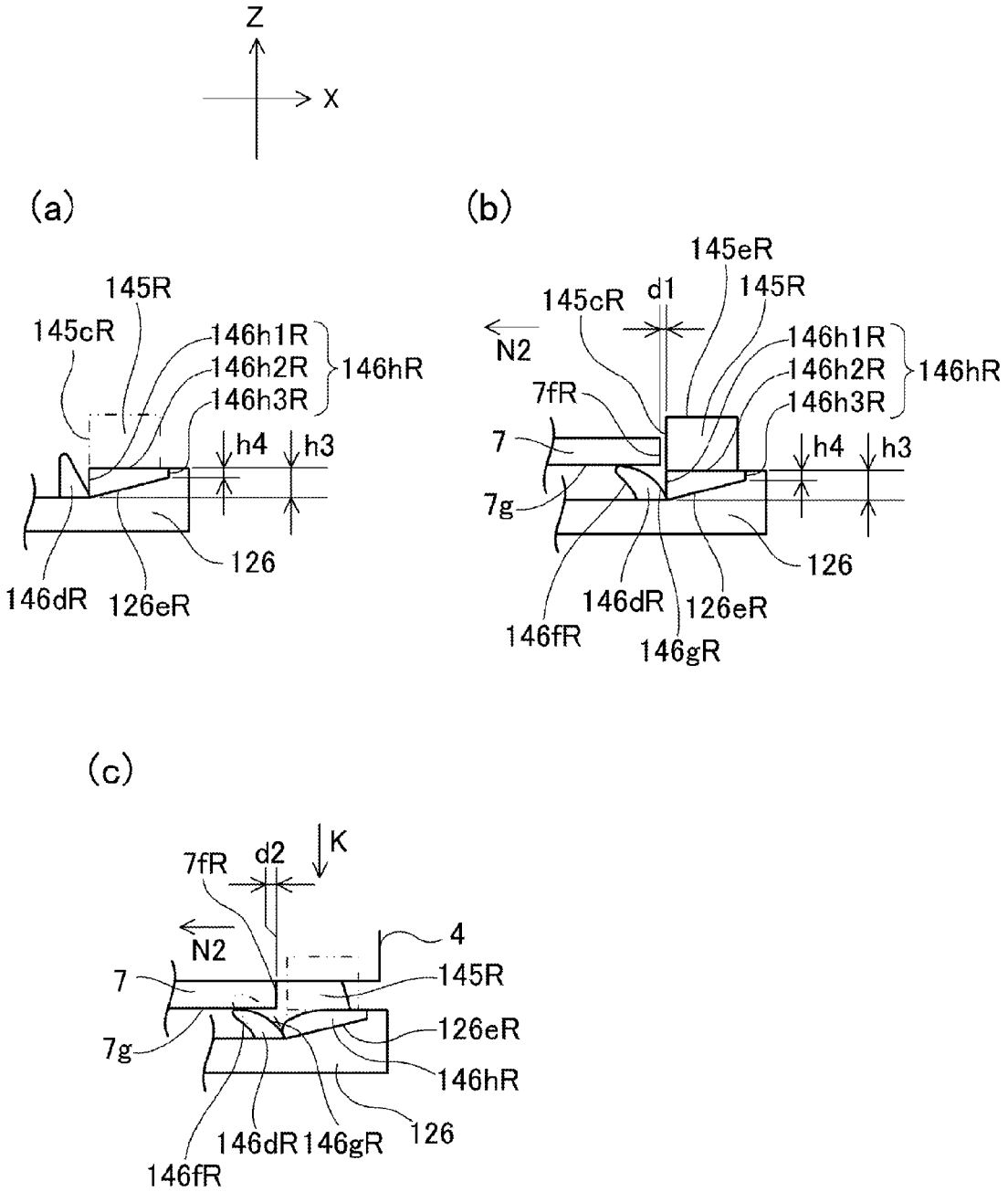
FIG. 11 is a drawing which shows how the lengthwise right end portion of the cleaning unit is sealed in the second embodiment.

Next, referring to FIGS. 9-11, the cleaning unit 108 in the second embodiment is described. FIG. 9 is a drawing which shows how the cleaning unit 108 is structured to keep the cleaning unit sealed at its lengthwise ends. More specifically, FIG. 9(*a*) is a plan view of the cleaning unit 108 as seen from the direction perpendicular to the supporting surface of the cleaning unit frame. FIG. 9(*b*) is a sectional view of the cleaning unit 108, at the plane W2-W2 in FIG. 9(*a*). FIG. 10 is a perspective view of the elastic component and its adjacencies in the second embodiment. FIG. 11 is a sectional view of the cleaning unit 108, at the plane V2-V2 in FIG. 9(*a*). More specifically, FIG. 11(*a*) shows the state of the combination of the cleaning unit frame 26, elastic component 146R, and end seal 145R, before the attachment of the cleaning blade 7. FIG. 11(*b*) shows the state of the combination of the cleaning unit frame 26, elastic component 146R, and end seal 145R after the attachment of the cleaning blade 7. FIG. 11(*c*) shows the state of the combination of the cleaning unit frame 26, elastic component 146R, end seal 145R, and photosensitive drum 4, after the attachment of the photosensitive drum 4. The components, their portions, etc., of the cleaning unit 108 in this embodiment, which are the same in structure and/or function as the counterparts in the first embodiment are not described here.

<Injection Molding of End Seal, and Shape of End Seal>

First, referring to FIGS. 9(*a*) and 10, an elastic component 146R as the first sealing component is formed in the cleaning unit frame 126 by injection molding. The elastic component 146R has a vertical sealing section 146*d*R for sealing the gap between the cleaning blade 7 and cleaning unit frame 126, and end seal bearing section 146*b*R having the end seal adhesion surface to which the end seal 145R, as the second sealing component, is to be pasted.

Next, referring to FIGS. 9(*b*) and 10, the end seal bearing section 146*b*R of the elastic component 146R, which is the front section of the elastic component 146R in terms of the direction Y has the top surface 146*b*1R, contacting surface 146*b*2R, and proximity surface 146*b*3R. The top surface 146*b*1R is airtightly in contact with the elastic component contacting front area 126*b*R of the cleaning unit frame 126. The contacting surface 146*b*2R is in contact with the adhesion surface 145*b*R of the end seal 145R. The proximity surface 146*b*3R is the rear surface of the elastic component 146R in terms of the direction Y, and is in connection to the vertical sealing section 146*d*R.

The end seal bearing section 146*b*R is roughly in the form of a trapezoid, being shaped so that its contacting surface 146*b*2R is slanted relative to the direction Y, making the seal bearing section 146*b*R thickest at h2 at its inward end, and thinnest at h1 at its outward end, in terms of the direction Z. The elastic component 146R is formed by injection molding in such a shape that its rear surface 146*c*R, in terms of the direction Y, airtightly contacts the elastic component contacting rear area of the cleaning unit frame 126. The elastic component 146R is formed by injection molding so that the top surface 146*d*1R of the vertical sealing section 146*d*R will be above the cleaning blade supporting surface 126*c* of the cleaning unit frame 126 by a distance J in terms of the direction Z.

Next, referring to FIG. 11, the shape of the elastic component 146R, which is on the outward side of the cleaning blade 7 in terms of the lengthwise direction, is described. The elastic component 146R has an end seal bearing outward section 146*h*R as the second deformable section of the elastic component 146R, which keeps sealed the lengthwise outward side of the cleaning blade 7. In terms of the lengthwise direction, the thickness h3 of the end seal bearing outward section 146*h*R, at its inward surface 146*h*1R in terms of the direction X, is greater than the thickness h4 of the end seal bearing outward section 146*h*R, at its outward surface 146*h*3R in terms of the direction X. Thus, the elastic component contacting outward surface 126*e*R of the cleaning unit frame 126 is slanted.

<Structural Arrangement for Preventing Waste Toner Leakage at Lengthwise Ends>

Next, referring to the sectional views of the cleaning unit 108 at a plane parallel to the widthwise direction of the unit, how the gap located between the cleaning blade 7 and end seal 145R of the cleaning unit 108 in terms of the lengthwise direction is kept sealed to prevent the waste toner from leaking is descried following the sequential steps through which the cleaning unit 108 is assembled. More concretely, referring to FIGS. 9, 11(*a*), 11(*b*) and 11(*c*), the structural arrangement of the cleaning unit 108, which is for keeping sealed, the gap located between the cleaning blade 7 and end seal 145R, at the lengthwise non-driven end of the cleaning unit 108, to prevent the waste toner leakage, is described. First, the vertical sealing section 146*d*R of the elastic component 146R is formed in the cleaning unit frame 126 by injection molding. The vertical sealing section 146*d*R is shaped so that its thickness h3 at its upstream surface 146*h*1R in terms of the X direction is greater than its thickness h4 at its downstream surface 146*h*3R. That is, referring to FIG. 11(*b*), the vertical sealing section 146*d*R is shaped so that it is thinnest at the downstream surface 146*he*R, being h4, and gradually increases, being h3 at the upstream surface 146*h*1R. That is, the closer to the downstream end surface 7*f*R of the cleaning blade 7, the thicker it is.

<Pasting of End Seal, and Attachment of Cleaning Blade>

In the second embodiment, the end seal 145R is pasted to the end seal bearing section 146*b*R and the end seal bearing outward section 146*h*R. Then, the cleaning blade 7 is attached to the cleaning unit frame 126. FIG. 11(*b*) is a sectional view of the combination of the cleaning unit frame 126, cleaning blade 7, end seal 145R, and elastic component 146R, after the attachment of the cleaning blade 7 to the cleaning unit frame 126. There is a gap d1 between the downstream end surface 7*f*R of the cleaning blade 7 in terms of the direction X, and inward lateral surface 145*c*R of the end seal 145R. The presence of the gap d1 can prevent the problem that when the cleaning blade 7 is attached to the cleaning unit frame 126, the downstream end portion of the cleaning blade 7 in terms of the direction X runs onto the surface layer 145*e*R of the end seal 145R.

Further, the vertical sealing section 146*d*R airtightly conforms to the bottom surface 7*g* and support section 7*b* of the cleaning blade 7. The lateral surface 146*g*R, in terms of the direction +X, of the vertical sealing section 146*d*R, is slanted. Therefore, the force applied to the cleaning blade 7 to attach the cleaning blade 7 to the cleaning unit frame 108 presses on the lateral surface 146*g*R. Thus, the vertical sealing section 146*d*R remains airtightly in contact with the cleaning blade 7 while being made to lean in the direction N2 in FIG. 11(*b*).

Next, shown in FIG. 11(*c*) is the state of the cleaning unit 108 after the attachment of the photosensitive drum 4. The two-dot chain line indicates the state (contours) of the elastic component 146R and end seal 1145R before the attachment of the photosensitive drum 4. As the photosensitive drum 4 is attached, the force applied to the photosensitive drum 4 in the direction K presses on the end seal bearing outward section 146*h*R of the elastic component 146R, through the end seal 145R. The outward lateral surface 146*g*R, in terms of the direction +X, of the end seal bearing outward section 146*d*R, which faces the surface 146*h*1R of the seal bearing outward section 146*h*R in terms of the direction −X, is slanted in the direction −X. Therefore, there is a space between the surface 146*g*R and surface 146*h*1R, into which the elastic component 146R is allowed to expand. Thus, as pressure is applied to the photosensitive drum 4 to attach the photosensitive drum 4 to the cleaning unit frame 126, the seal bearing outward section 146*h*R is deformed by the pressure in such a manner that it is deformed more on its downstream side (direction −X side), where is thicker, than on its upstream side, which it is thinner.

Consequently, the seal bearing outward section 146*h*R of the elastic component 146R deforms in the direction indicated by the arrow mark N in FIG. 11(*b*). Therefore, the inward lateral surface 145*c*R of the end seal 145R is moved in the direction indicated by the arrow mark N2, reducing thereby the gap between the inward lateral surface 145*c*R of the end seal 145R and the outward lateral surface 7*f*R of the cleaning blade 7, from d1 to d2. In other words, the cleaning unit 108 is improved in terms of the prevention of the waste toner leakage through the gap between the cleaning blade 7 and the inward lateral surface 145*c*R of the end seal 145R.

Further, the attachment of the photosensitive drum 4 causes the cleaning blade 7 to deform, increasing thereby the amount of pressure applied to the vertical sealing section 146*d*R, which in turn increases the amount by which the vertical sealing section 146R is made to lean in the direction N2, increasing thereby the amount of the reaction force generated in the vertical sealing section 146R. Therefore, the cleaning unit 108 can be improved in terms of the prevention of the waste toner leakage, without requiring the contact pressure between cleaning blade 7 and photosensitive drum 4 to be increased.

As described above, simply pasting the end seal 145R closer to the lengthwise end of the cleaning blade 7 makes it more likely for the cleaning blade 7 to run onto the surface layer 145*e*R of the end seal 145R during the attachment of the cleaning blade 7. It is possible that as the cleaning blade 7 runs onto the surface layer 145*e*R, a gap will be created between the photosensitive drum and end seal 145R, and this gap will allow the waste toner to leak. In the second embodiment, however, the attachment of the photosensitive drum 4 reduces the gap between the cleaning blade 7 and end seal 145R from d1 to d2. Thus, the cleaning unit 108 is better sealed in terms of the prevention of the waste toner leakage, without being reduced in its assembly efficiency.

In the second embodiment, the top surface 145*b*1R of the elastic component 146R, to which the end seal 145R is adhered, is formed of thermoplastic elastomer as in the first embodiment. Therefore, the gap T between the cleaning blade 7 and end seal 145R in terms of the widthwise direction can be reduced by the attachment of the cleaning blade and photosensitive drum 4 to the cleaning unit frame 126. With the reduction in the gap T, the cleaning unit 108 is better sealed in terms of the prevention of the waste toner leakage.

To describe the additional effects of the second embodiment of the present invention, the end seal bearing outward section 146*h*R of the elastic component 146R is formed of thermoplastic elastomer, in such a shape and size that in terms of the lengthwise direction, the end seal bearing outward portion of the elastic component 146R, which is adjacent to the end surface 7*f*R of the cleaning blade 7 in terms of the direction +X, is thicker than the outward end portion of the end seal bearing outward section 146*h*R. With the provision of the end seal bearing outward section 146*h*R, the gap between the end surface 7*f*R of the cleaning blade 7 and the end seal 145R in terms of the lengthwise direction is reduced from d1, improving thereby the cleaning unit 108 in terms of the prevention of the waste toner leakage at the lengthwise ends, by the attachment of the photosensitive drum 4. Further, even if the end seal 145R is reduced in the length L of its protrusive section 145*a*R, the cleaning unit 108 remains just as well sealed as, or better sealed than, a conventional cleaning unit, in terms of the waste toner leakage. In other words, the present invention can reduce the end seal 145R in size, which in turn reduces the cleaning unit 108 in cost.

The cost of the thermoplastic elastomer as the material for the elastic component 146R is virtually no different from that of the foamed synthetic resin which has been widely used as the material for the conventional elastic component 146R. Therefore, the elastic component 146R in accordance with the present invention is no higher in cost than a conventional elastic component, and therefore, the cleaning unit 108 in accordance with the present invention is no higher in cost than a conventional cleaning unit. Incidentally, the structural arrangement for preventing the waste toner from leaking at the drive side end of the cleaning unit 108 in terms of the lengthwise direction is the same as the above described one for the non-drive end of the cleaning unit 108. Therefore, it is not described.

Embodiment 3

Figure 13:
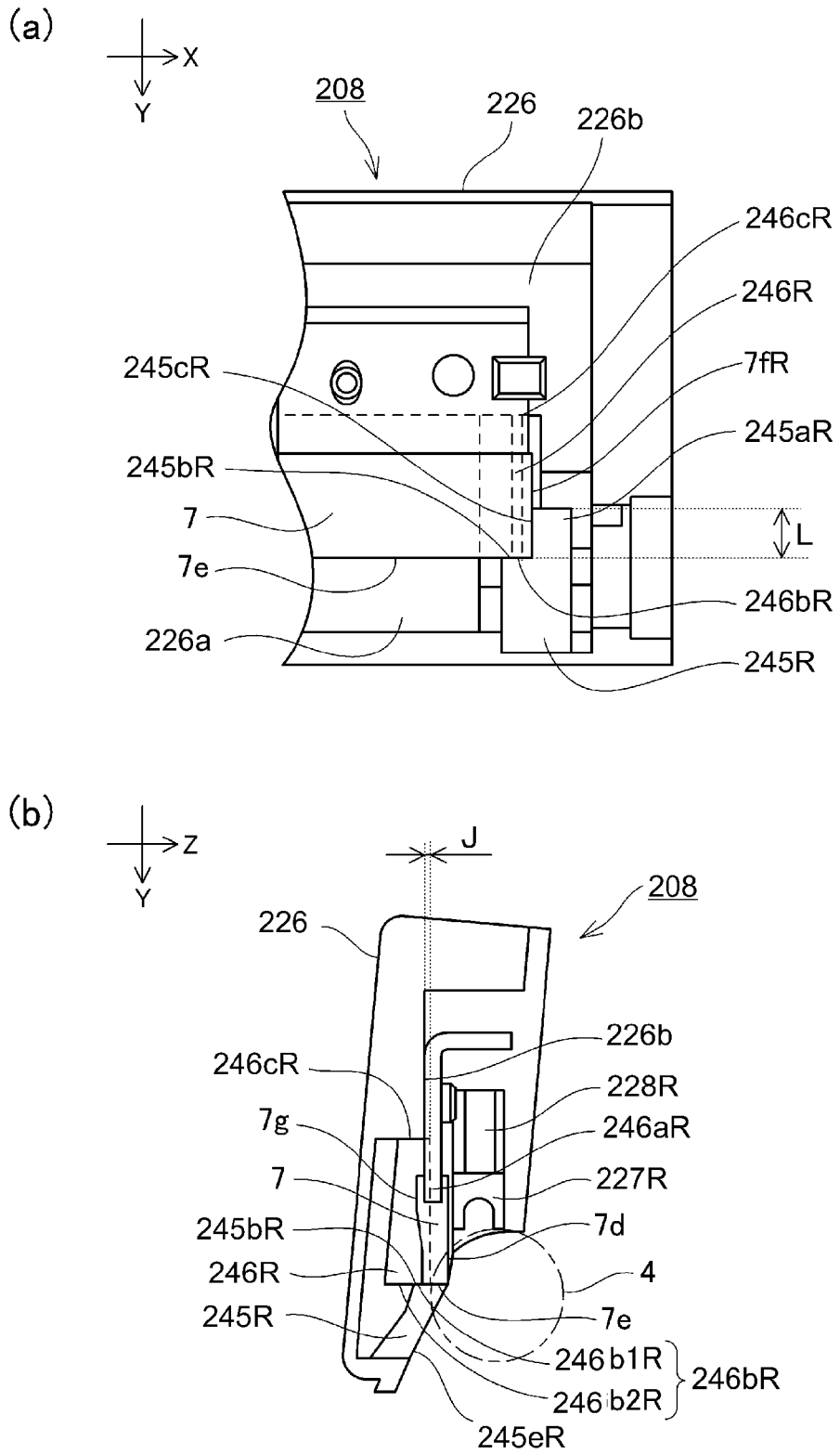
FIG. 13 is a drawing which shows how the lengthwise right end portion of the cleaning unit is sealed in the third embodiment.
Figure 14:
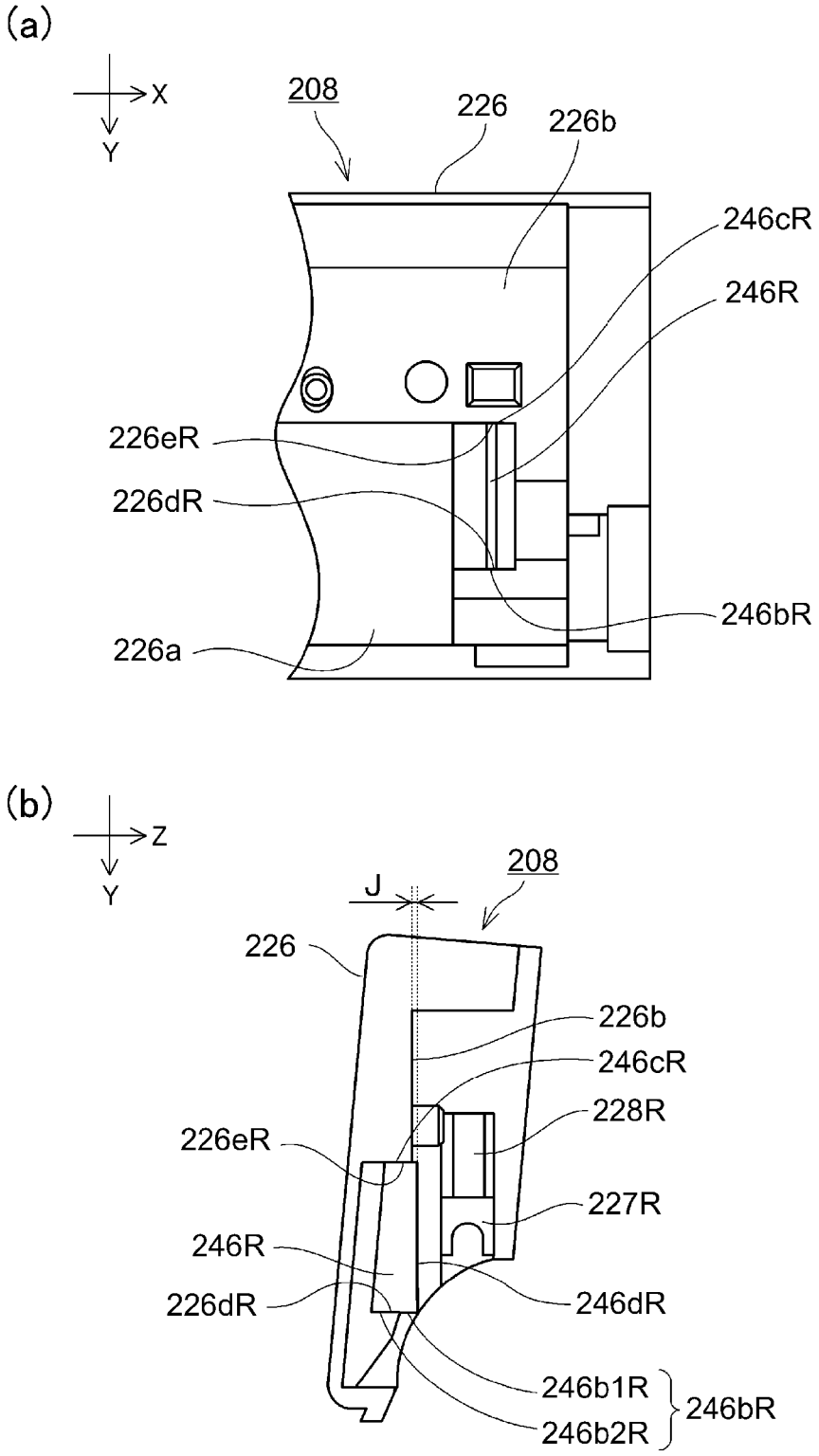
FIG. 14 is a drawing which shows the seal structure at the lengthwise end and its adjacencies in the third embodiment.

Next, referring to FIGS. 13 and 14, the structural arrangement, in the third embodiment, for preventing the waste toner from leaking from the cleaning unit 208, at the lengthwise ends of the cleaning blade 7, is described in detail, following the sequential steps through which the cleaning unit 208 is assembled. FIG. 13 is a drawing for showing the structural arrangement, in the third embodiment, for preventing the waste toner from leaking from the cleaning unit 208, at the lengthwise ends of the cleaning blade 7. FIG. 13(*a*) is a plan view of the lengthwise end of the cleaning unit 208, as seen from the direction perpendicular to the supporting surface of the cleaning unit frame. It shows the state of the cleaning unit 208 right after the attachment of the cleaning blade 7. FIG. 13(*b*) is a sectional view of the right end portion of the cleaning unit 208, as seen from within the cleaning unit 208. It also shows the state of the cleaning unit 208 immediately after the attachment of the cleaning blade 7. FIG. 14 is a drawing for showing the structural arrangement for keeping the cleaning unit 208 sealed at the lengthwise ends of the cleaning blade 7. More specifically, FIG. 14(*a*) is a plan view of the right end portion of the cleaning unit frame as seen from the direction perpendicular to the supporting surface of the cleaning unit frame. It shows the state of the lengthwise end portion of the cleaning unit 208 before the attachment of the cleaning blade 7. FIG. 14(*b*) is a sectional view of the right end portion of the cleaning unit 208, as seen from within the cleaning unit 208. It shows the state of the lengthwise end portion of the cleaning unit 208 before the attachment of the cleaning blade 7. In FIG. 13(*b*), the photosensitive drum 4 is indicated by an imaginary line (singe-dot chain line). Further, the lengthwise and widthwise directions of the cleaning unit will be referred to as directions X and Y, respectively. The direction perpendicular to the directions X and Y will be referred to as the direction Z (directions which arrow marks point will be referred to as positive (+) directions).

First, the vertical seal 246R is formed by molding, in cleaning unit frame 226. Referring to FIG. 14(*a*), the vertical seal 246R is in the form of a rib, which extends in the direction Y. Next, referring to FIG. 14(*b*), the front end surface 246*b*R of the vertical seal 246R in terms of the direction Y has a contacting surface 246*b*1R which contacts the end seal 245R, and a frame contacting section 246*b*2R which airtightly contacts the front airtight contact section 226*d*R of the cleaning unit frame 226.

Referring to FIG. 13(*b*), the contacting surface 246*b*1R is formed so that it is roughly level with the end surface 7*e* of the cleaning blade 7 in terms of the direction Y. Referring to FIG. 14(*b*), the rear end surface 246*c*R of the vertical seal 246R in terms of the direction Y is formed so that it airtightly contacts the rear airtight contact section 226*e*R of the cleaning unit frame 226. Also referring to FIG. 14(*b*), the vertical seal 246R is formed so that prior to the attachment of the cleaning blade 7, the top surface 246*d*R of the vertical seal 246R will be above the supporting surface 226*b* of the cleaning unit frame 226 by an amount J, in terms of the direction Z.

Referring to FIG. 13(*b*), the end seal 245R is positioned so that the vertical seal contacting surface 245*b*R (FIG. 8) of the end seal 245R contacts the end seal contacting surface 246*b*1R of the vertical seal 246R. Further, the cleaning blade 7 is attached to the supporting surface 226*b* of the cleaning unit frame 226. The end seal 245R and cleaning blade 7 may be reversed in the order in which they are attached to the cleaning unit frame 226. Lastly, the photosensitive drum 4 is attached to the cleaning unit frame 226. As the photosensitive drum 4 is attached, the vertical seal contacting surface 245*b*R of the end seal 245R comes into contact with the end surface 7*e* of the cleaning blade 7, and the surface layer 245*e*R of the end seal 245R comes into contact with the photosensitive drum 4. Thus, the end seal 245R seals the gap between the vertical seal 246R and cleaning blade 7, and the gap between the photosensitive drum 4 and cleaning unit frame 226, at the lengthwise ends of the cleaning unit 208, preventing thereby the waste toner leakage.

Further, referring to FIG. 13(*a*), the end seal 245R has a protrusive portion 245*a*R, which is on the outward side of the end surface 7*f* of the cleaning blade 7 in terms of the lengthwise direction, and protrudes from the main section of the end seal 245R by a length of L in the direction Y. The cleaning blade 7 is positioned so that its lengthwise end surface 7*f*R will be in contact with, or in the adjacencies of, the inward surface 245*c*R of the protrusive portion 245*a*R of the end seal 245.

At this time, how the waste toner is prevented from leaking through the gap between the cleaning blade 7 and vertical seal 246R is described. Referring to FIG. 13(*b*), the vertical seal 246R is formed so that its top surface 246*d*R is larger by the amount J than the supporting surface 226*b*. Therefore, as it comes into contact with the bottom surface 7*g* of the cleaning blade 7, it is squashed by the cleaning blade 7. Since the vertical seal 246R is elastic, it is made by the compression load to deform in such a manner that it conforms in shape to the bottom surface 7*g* of the cleaning blade 7. Therefore, no gap is created between itself and the cleaning blade 7. Further, the vertical seal 246R is formed of thermoplastic elastomer, being therefore sticky. Therefore, it sticks to the cleaning blade 7. Therefore, it is ensured that the area of contact between the vertical seal 246R and cleaning blade 7 remains airtightly sealed. For the reasons given above, it is most unlikely that the waste toner will leak through the area of contact between the cleaning blade 7 and vertical seal 246R.

Figure 19:
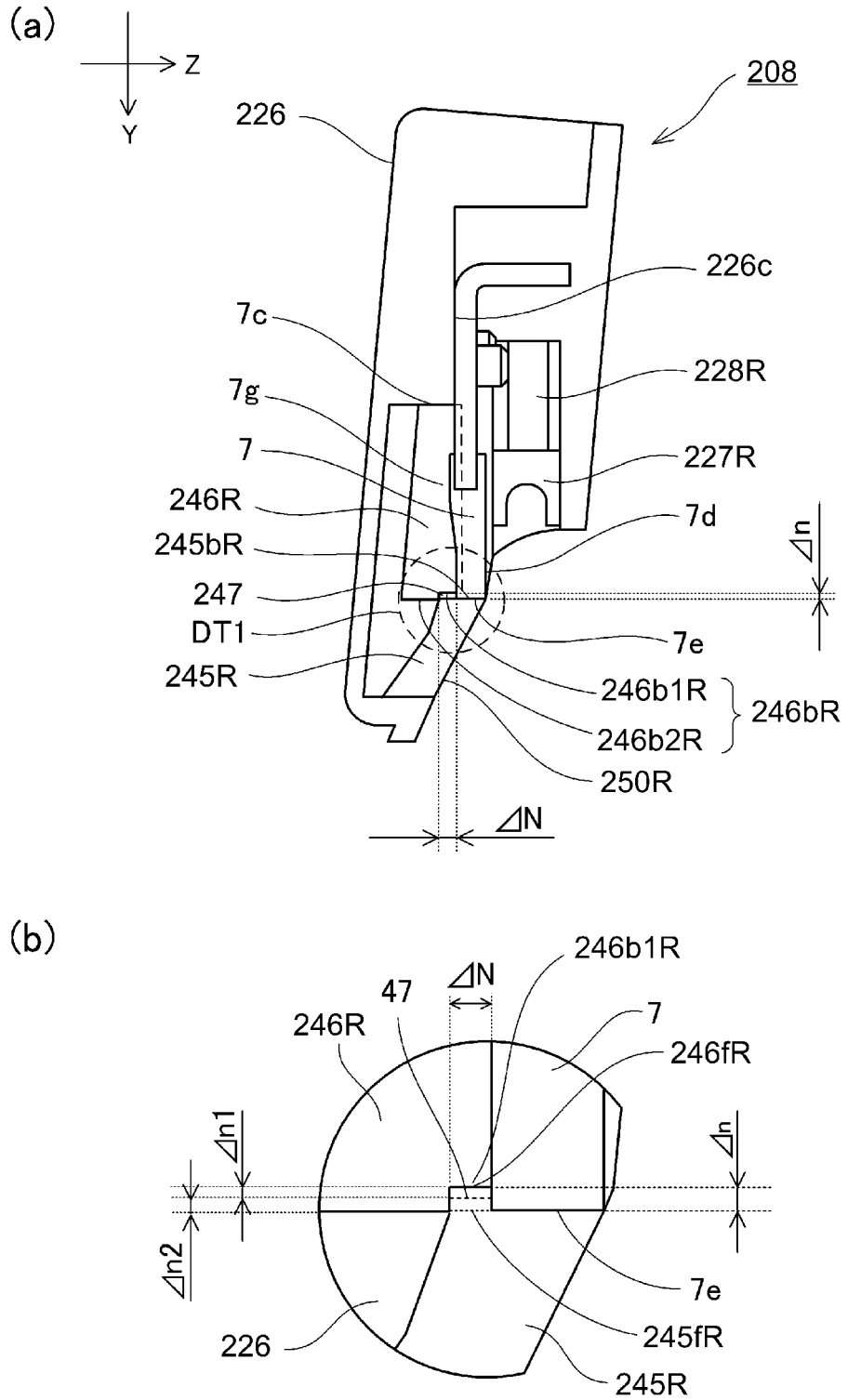
FIG. 19 is a drawing which shows how the lengthwise right end portion of the cleaning unit is sealed in the third embodiment.

Next, referring to FIG. 19, how the gap surrounded by the cleaning blade 7, end seal 245R and vertical seal 246R is sealed in the third embodiment is described. FIG. 19 is a drawing for describing how the cleaning unit frame 226 is kept sealed to prevent the waste toner from leaking at the lengthwise ends. More specifically, FIG. 19(*a*) is a drawing which shows the gap created by the cleaning blade 7, end seal 245R, and vertical seal 246R. FIG. 19(*b*) is an enlarged view of the area DT1 encircled by a dotted line in FIG. 19(*a*).

Here, how the area of contact between the end seal 245R and vertical seal 246R is sealed by the vertical seal 246, assuming that the material for the vertical seal 246R is thermoplastic elastomer. In the third embodiment, the vertical seal 246R is positioned in the adjacencies of the end seal 245R so that the distance between the vertical seal 246R and end seal 245R is less after the former was compressed than before it is compressed. More concretely, referring to FIG. 19(*b*), as the vertical seal 246R is squashed by the cleaning blade 7, it deforms in such a shape that its end seal contacting surface 246*b*1R extends by an amount Δn1 in the direction Y. Therefore, the gap 247 is reduced by the amount Δn1. That is, the cleaning unit 208 is better sealed.

On the other hand, in a case where the vertical seal 246 is formed of foamed synthetic resin as the vertical seal of a conventional cleaning unit, the amount Δn1 by which the vertical seal is compressed is virtually zero. Further, because the vertical seal is formed of foamed synthetic resin, even if it is squashed by the cleaning blade 7, all that happens is that the cells of the foamed synthetic resin are reduced in size. Thus, the vertical seal hardly extends in the direction Y. Therefore, even if the end seal and vertical seal happen to come into contact with each other, the contact is unlikely to be airtight. Beside, if gaps happen between them, they are difficult to seal. That is, in the case where the material for the vertical seal is foamed synthetic resin, it is difficult to make the vertical seal come into contact with the end seal.

In the third embodiment, the vertical seal 246R is formed of thermoplastic elastomer, and is positioned so that it is pressed upon the end seal 245R. Thus, it is unlikely for gaps to be created by the vertical seal 246R, end seal 245R and cleaning blade 7. Therefore, the cleaning unit is improved in terms of the prevention of the waste toner leakage. Therefore, even if the protrusive portion 245*a*R of the end seal 245R is reduced in its length L, the cleaning unit is kept in the state in which the waste toner does not leak. In other words, it is allowed to reduce the end seal 245R in size. Therefore, it is possible to reduce the cleaning unit in cost.

Further, the cost of the thermoplastic elastomer as the material for the elastic component 246R is virtually no different from that of the foamed synthetic resin which has been widely used as the material for the conventional end seal 246R. Therefore, the elastic component 246R in accordance with the present invention is no higher in cost than a conventional elastic component, and therefore, the cleaning unit 208 in accordance with the present invention is no higher in cost than a conventional elastic cleaning unit. Incidentally, the structural arrangement for preventing the waste toner from leaking at the drive side end of the cleaning unit 208 in terms of the lengthwise direction is the same as the above described one for the non-drive end of the cleaning unit 208. Therefore, it is not described.

As described above, in the third embodiment, as the cleaning blade 7 and photosensitive drum 4 are attached, the vertical seal 246R is compressed, being thereby deformed in such a manner that it partially extends to the adjacencies of the end seal 245R. Therefore, it is possible to prevent the problem that gaps are created between the vertical seal 246 and end seal 245. Therefore, it is possible to improve the cleaning unit in terms of the prevention of the waste toner leakage. Further in the case of the structural arrangement for the cleaning unit 208 in the third embodiment, it does not occur that the end seal 245 runs onto the vertical seal 246. Therefore, it does not occur that the end seal 245 is made to warp by the vertical seal 246. Therefore, it is possible to prevent gaps from occurring between the end seal 245 and cleaning blade 7. Therefore, it is possible to improve the cleaning unit in terms of the prevention of the waste toner leakage.

Embodiment 4

Figure 15:
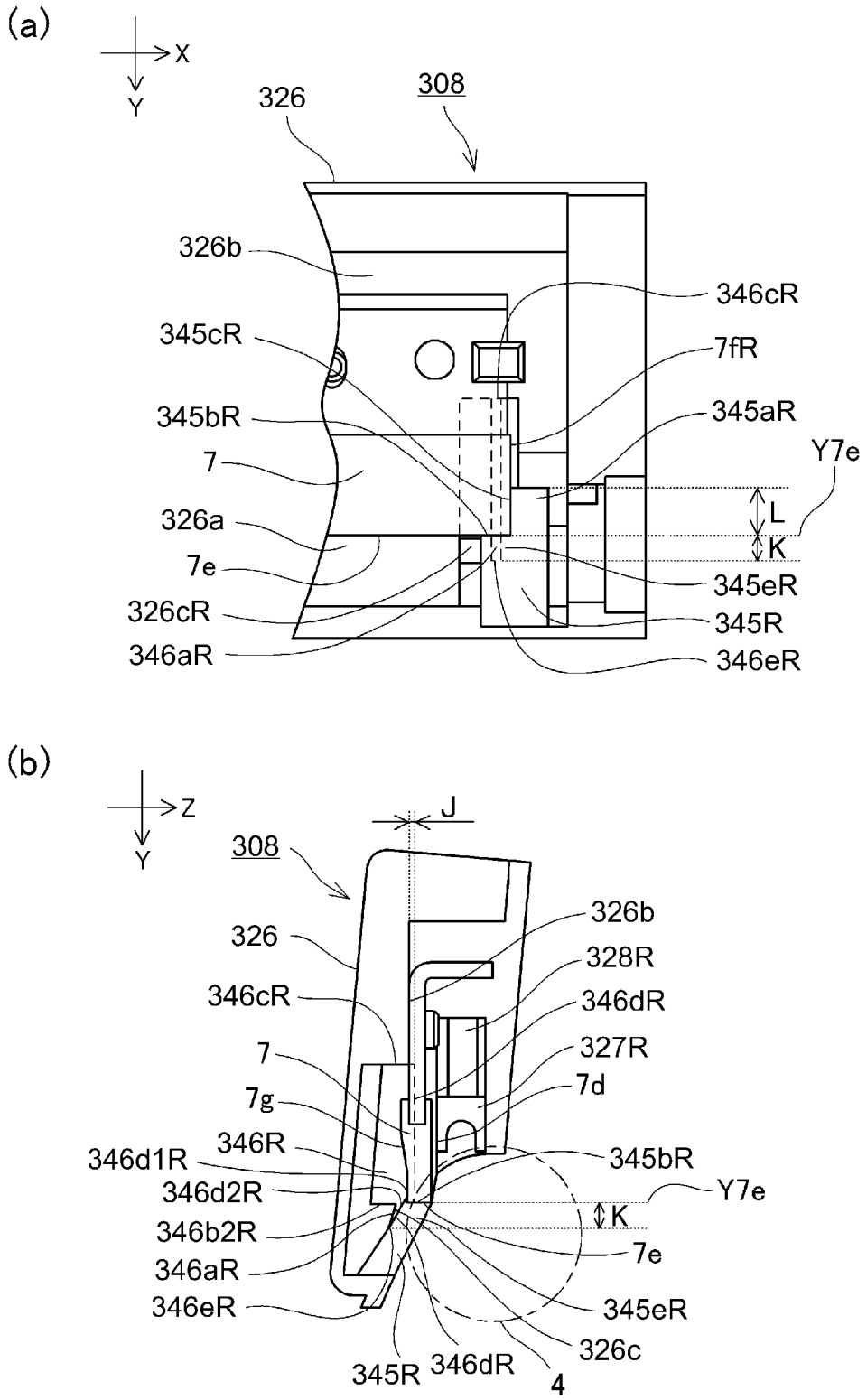
FIG. 15 is a drawing which shows how the lengthwise right end portion of the cleaning unit is sealed in the fourth embodiment.
Figure 16:
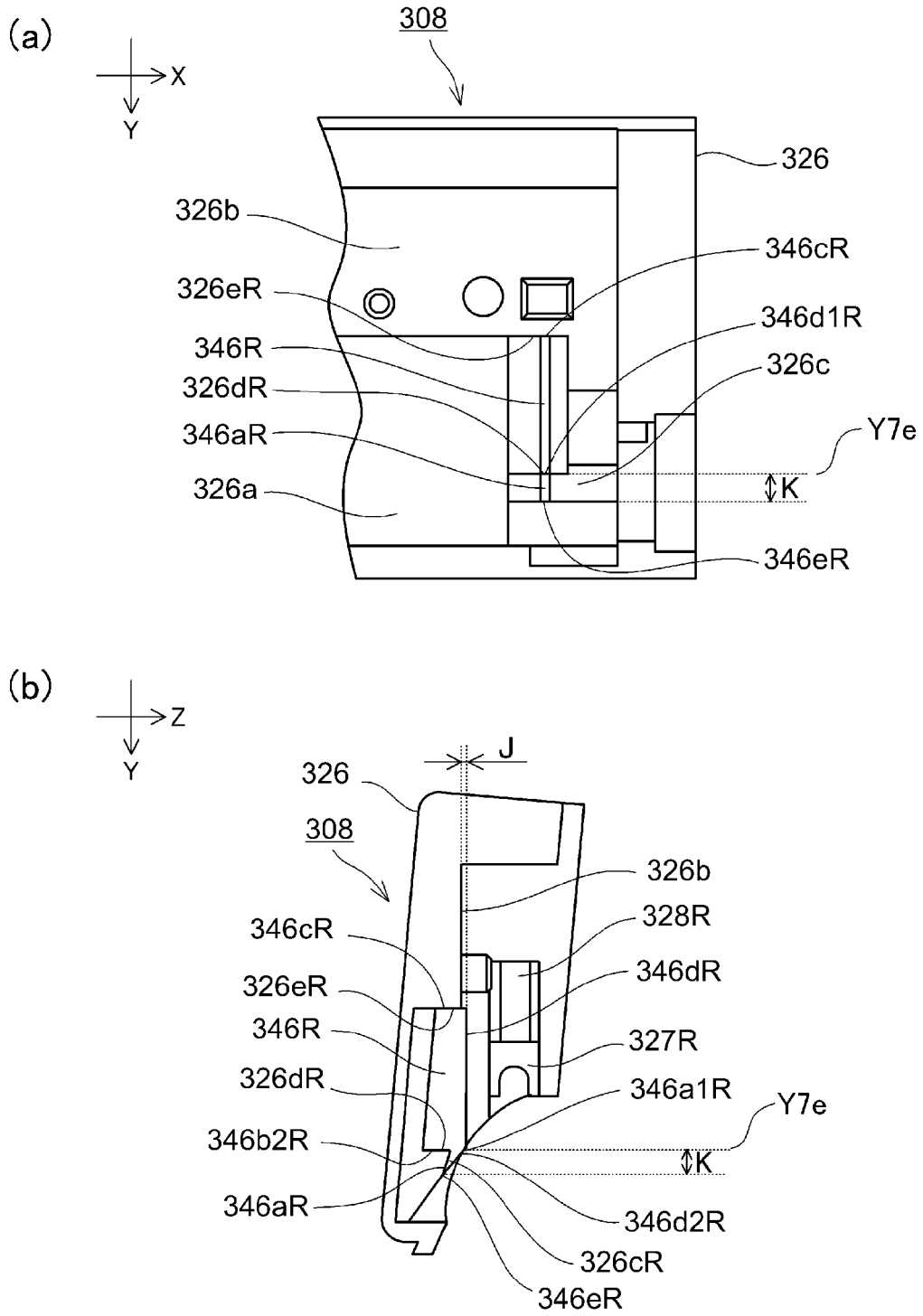
FIG. 16 is a drawing which shows how the lengthwise right end portion of the cleaning unit is sealed in the fourth embodiment.
Figure 17:
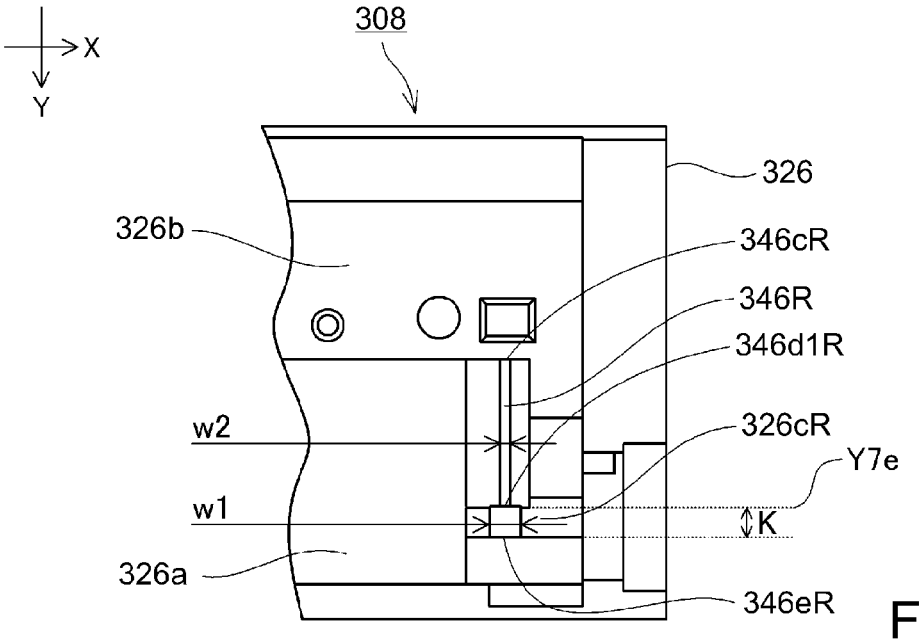
FIG. 17 is a drawing which shows how the lengthwise right end portion of the cleaning unit is sealed in the fourth embodiment.
Figure 18:
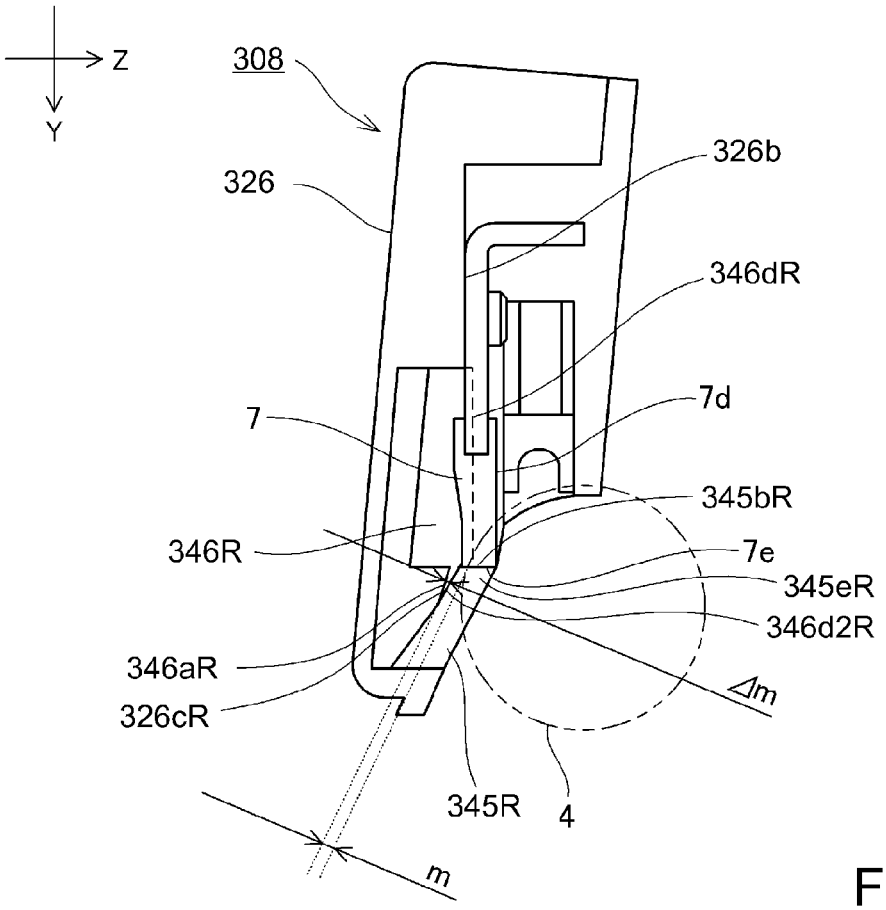
FIG. 18 is a drawing which shows how the lengthwise right end portion of the cleaning unit is sealed in the fourth embodiment.

Next, referring to FIGS. 15-18, the fourth embodiment of the present invention is described. FIG. 15 is a drawing for showing the structural arrangement, in the fourth embodiment, for keeping the lengthwise ends of the cleaning unit sealed in terms of the waste toner leakage. More specifically, FIG. 15(*a*) is a plan view of the lengthwise right end portion of the cleaning unit in the fourth embodiment, as seen from the direction perpendicular to the supporting surface of the cleaning unit frame. It shows the state of the lengthwise end after the attachment of the cleaning blade. FIG. 15(*b*) is a sectional view of the lengthwise right end portion of the cleaning unit, as seen from within the cleaning unit after the attachment of the cleaning blade. FIG. 16 is a drawing for showing the structural arrangement, in the fourth embodiment, for keeping the lengthwise ends of the cleaning unit sealed. FIG. 16(*a*) is a plan view of the lengthwise right end portion of the cleaning unit, as seen from the direction perpendicular to the supporting surface of the cleaning unit frame before the attachment of the cleaning blade. FIG. 16(*b*) is a sectional view of the lengthwise right end portion of the cleaning unit as seen from within the cleaning unit frame before the attachment of the cleaning blade. FIG. 17 is a drawing of a modified version of the cleaning unit in the fourth embodiment. FIG. 17(*a*) is a plan view of the lengthwise right end portion of the cleaning unit, as seen from the direction perpendicular to the supporting surface of the cleaning unit frame before the attachment of the cleaning blade. FIG. 17(*b*) is a sectional view of the lengthwise right end portion of the cleaning unit as seen from within the cleaning unit frame before the attachment of the cleaning blade. FIG. 18 is a drawing for showing the structural arrangement in the fourth embodiment, for keeping the lengthwise ends of the cleaning unit sealed in terms of the waste toner leakage. In FIGS. 15-18, the lengthwise and widthwise directions of the cleaning unit are referred to as the directions X and Y, respectively. The direction which is perpendicular to both the directions X and Y is referred to as the direction Z (directions indicated by arrow marks in drawings are referred to as positive directions). The components, their portions, and their functions, in the fourth embodiment, which are the same as or similar to the counterparts in the third embodiment are not described.

<Structural Arrangement for Keeping Waste Toner Storage Sealed>

FIGS. 15-17, the structural arrangement, in this embodiment, for keeping sealed the cleaning unit, at the lengthwise ends of the cleaning blade 7, in terms of the waste toner leakage, is described, following the sequential steps through which the cleaning unit is assembled.

First the vertical seal 346R is formed by molding in cleaning unit frame 326. Referring to FIG. 16(*a*), the vertical seal 346R is in the form of a rib, which extends in the direction Y. Next, referring to FIG. 16(*b*), the front end 346*e*R of the vertical seal 346R in terms of the direction Y is provided with a protrusive portion 346*a*R, which runs onto the end seal adhesion surface 326*c*R of the cleaning unit frame 326, to which the end seal 345R is pasted. This protrusive portion 346*a*R of the vertical seal 346R is positioned so that it will be pinched between the cleaning unit frame 326 and end seal 345R. In the fourth embodiment, the vertical seal 346R is positioned in the adjacencies of the end seal 345R in such a manner that the distance between the vertical seal 346R and end seal 445R will be less seal after the compression of the vertical seal 246R than before the compression. Also as in the third embodiment, the vertical seal 346R is provided with a cleaning unit frame contacting surface 346*b*2R, which airtightly contacts the vertical seal contacting front surface 326*d*R of the cleaning unit frame 326. Further, the vertical seal 346R is formed so that its rear end surface 346*c*R in terms of the direction Y airtightly contacts the vertical seal contacting rear surface of the cleaning unit frame 326.

Referring to FIG. 15(*b*), the protrusive portion 346*a*R is provided with a section 346*d*2R (FIG. 16) shaped so that its top surface 346*d*R is slanted in the direction −Z from the ridge line 346*d*1R toward the edge 346*e*R. Also as in the third embodiment, the vertical seal 346R is formed so that before the attachment of the cleaning blade 7, the top surface 346*d*R extends beyond the supporting surface 326*b* of the cleaning unit frame 326 in the direction Z by a distance J.

Also referring to FIG. 15, it is assumed here that in terms of the direction Y, the distance between the position Y7*e* of the end surface 7*e* of the cleaning blade 7 and the edge 346*e*R of the protrusive portion 346*a*R is referred to as the intrusion distance K. The shape of the vertical seal 346R in this embodiment is in the form of a rib having the protrusive portion 346*a*R having a slanted surface. However, the shape of the vertical seal 346R may be different from the one in this embodiment. For example, the vertical seal 346R may be shaped so that the first width (in terms of direction X) w1, or the width of the protrusive portion 346*a*R of the rib, is greater than the second width (in terms of direction X) w2, or the width of the other portion of the vertical seal 346R than the protrusive portion 346R (w1>w2). That is, the vertical seal 346R may be in any shape as long as it is shaped so that it is provided with the protrusive portion 346*a*R which runs onto the end seal adhesion surface 326*c*R of the cleaning unit frame 326.

Referring to FIG. 15(*b*), in terms of the direction Y, the end seal 345R is positioned so that as the cleaning blade 7 is attached, the cleaning blade contacting surface 345*b*R of the end seal 345R comes into contact with the end surface 7*e* of the cleaning blade 7. Further, the end seal 345R runs onto the protrusive portion 346*a*R of the vertical seal 346R by the intrusion distance K, measured from its cleaning blade contacting surface 345*b*R. The portion of the end seal 345R, which runs onto the protrusive portion 346*a*R of the vertical seal 346R, is referred to as an overlap portion 345*e*R. That is, the area of contact between the end seal 245R and vertical seal 346R is sealed by the placement of the overlap portion 345*e*R of the end seal 345R in contact with the protrusive portion 346*a*R of the vertical seal 345R. This arrangement is described later.

Next, the cleaning blade 7 is attached to the supporting surface 326*b* of the cleaning unit frame 326. Lastly, the photosensitive drum 4 is attached. As the photosensitive drum 4 is attached, the cleaning blade contacting surface 345*b*R of the end seal 345R comes into contact with the end surface 7*e* of the cleaning blade 7, and the surface layer 345*e*R of the end seal 345R comes into contact with the photosensitive drum 4. Further, the end seal 345R seals the gap between the cleaning blade 7 and cleaning unit frame 326, and also, the gap between the photosensitive drum 4 and cleaning unit frame 326, at the lengthwise ends of the cleaning unit frame 326, preventing thereby the waste toner leakage. Also as in the third embodiment, the end seal 345R is provided with the protrusive portion 345*a*R which is on the outward side of the lengthwise end surface 7*f*R of the cleaning blade 7, and protrudes in the direction Y by the length L, as shown in FIG. 15(*a*). The cleaning blade 7 is positioned so that its lengthwise end surface 7*f*R will contact, or be in the adjacencies of, the inward surface 345*c*R of the protrusive portion 345*a*R of the end seal 345R. Incidentally, the order in which the end seal 345R and cleaning blade 7 are attached may be opposite from the one in this embodiment.

At this time, how the waste toner is prevented from leaking from the area of contact between the cleaning blade 7 and vertical seal 346R in the fourth embodiment is described. Referring to FIG. 15(*b*), the vertical seal 346R is formed so that its top surface 346*d*R is greater by the amount J than the supporting surface 326*b*. Thus, as it comes into contact with the bottom surface 7*g* of the cleaning blade 7, it is squashed by the cleaning blade 7. Since the vertical seal 346R is elastic, it is deformed by the compression load in such a manner that it partially extends along the bottom surface 7*g* of the cleaning blade 7 while conforming in shape to the bottom surface 7*g*. Therefore, it is unlikely for gaps to be created between the vertical seal 346R and cleaning blade 7. Further, the vertical seal 346R is formed of thermoplastic elastomer, being therefore sticky. Thus, it sticks to the cleaning blade 7, ensuring that the area of contact between the vertical seal 346R and cleaning blade 7 remains airtightly sealed. Therefore, the cleaning unit 308 remains sealed as airtightly as possible in terms of the prevention of the waste toner leakage between the cleaning blade 7 and vertical seal 346R.

Next, the gap which occurs between the cleaning blade 7 and end seal 345R is described. In the fourth embodiment, the end seal 345R is positioned so that it runs onto the protrusive portion 346*a* of the vertical seal 346R. Therefore, the end seal 345R sometimes warps. However, the protrusive portion 346*a*R is wedgie, and therefore, the height by which the end seal 345R runs onto the protrusive portion 346*a*R is not much. Therefore, even if the end seal 345R warps, the amount by which the end seal 345R warps is very small. Therefore, it is unlikely for gaps to occur between the end surface 7*e* of the cleaning blade 7 and the cleaning blade contacting surface 345*b*R of the end seal 345R. Therefore, even if the protrusive portion 345*a*R of the end seal 345R is reduced in its length L, it is ensured that the waste toner remains satisfactorily sealed in the cleaning unit 308. In other words, it is allowed to reduce the end seal 345R in size. Therefore, it is possible to reduce the cleaning unit in cost.

The vertical seal 346R is formed by injection molding. Therefore, its protrusive portion 346*a*R, which is roughly in the shape of a wedge, can be easily formed. In comparison, in the case of a conventional vertical seal 346R, its material is foamed resin. Therefore, from the standpoint of processing foamed resin, it is rather difficult to form a vertical seal (346R), the protrusive portion (346*a*R) of which is in the form of a wedge. That is, it is difficult to form a vertical seal 346*a*R which does not cause the end seal 345R to significantly warp.

Further, the cost of thermoplastic elastomer as the material for the vertical seal 346R is barely different from that of the foamed synthetic resin which has been conventionally used as the material for the vertical seal 346R. Therefore, the usage of the thermoplastic resin does not increase the vertical seal 346R in cost. Thus, it is possible to reduce the cleaning unit 308 in cost.

Next, referring to FIG. 18, the additional effects of the fourth embodiment are described. In the fourth embodiment, the cleaning unit frame 326 is structured so that the distance between the end seal adhesion surface 326*c*R of the cleaning unit frame 326 and the peripheral surface of the photosensitive drum 4 becomes a preset distance m as shown in FIG. 18. Further, the end seal 345R is made thicker than the preset distance m. Thus, pasting the end seal 345R to the end seal adhesion surface 326*c*R prevents the waste toner from leaking through the gap between the photosensitive drum 4 and cleaning unit frame 326.

Further, the protrusive portion 346*a*R of the vertical seal 346R runs onto the end seal adhesion surface 326*c*R, and enters between the end seal adhesion surface 326*c*R and end seal 345R. Therefore, the height of the portion of the end seal adhesion surface 326*c*R, which corresponds in position to the overlap portion 345*e*R of the end seal 345R, increases by the height Δm of the wedgie portion 346*d*2R. That is, the distance m between the end seal adhesion surface 326*c*R and the peripheral surface of the photosensitive drum 4 is reduced. Therefore, the amount by which the end seal 345R is squashed across its overlap portion 345*e*R is increased. The end seal 345R is elastic. Therefore, the greater the amount by which the end seal 345R is squashed, the greater the contact pressure between the end seal 345R and photosensitive drum 4. Further, the protrusive portion 346*a*R of the vertical seal 346R is deformed by being compressed, in such a manner that the distance between the vertical seal 346R, and the end seal 345R which is positioned adjacent to the vertical seal 346R, is reduced. Further, the protrusive portion 346*a*R swells in the direction to cause the end seal 345 to press on the photosensitive drum 4, increasing thereby the contact pressure between the end seal 345R and photosensitive drum 4. Thus, the area of contact between the end seal 345R and photosensitive drum 7 is better sealed from the standpoint of prevention of the waste toner leakage.

Figure 20:
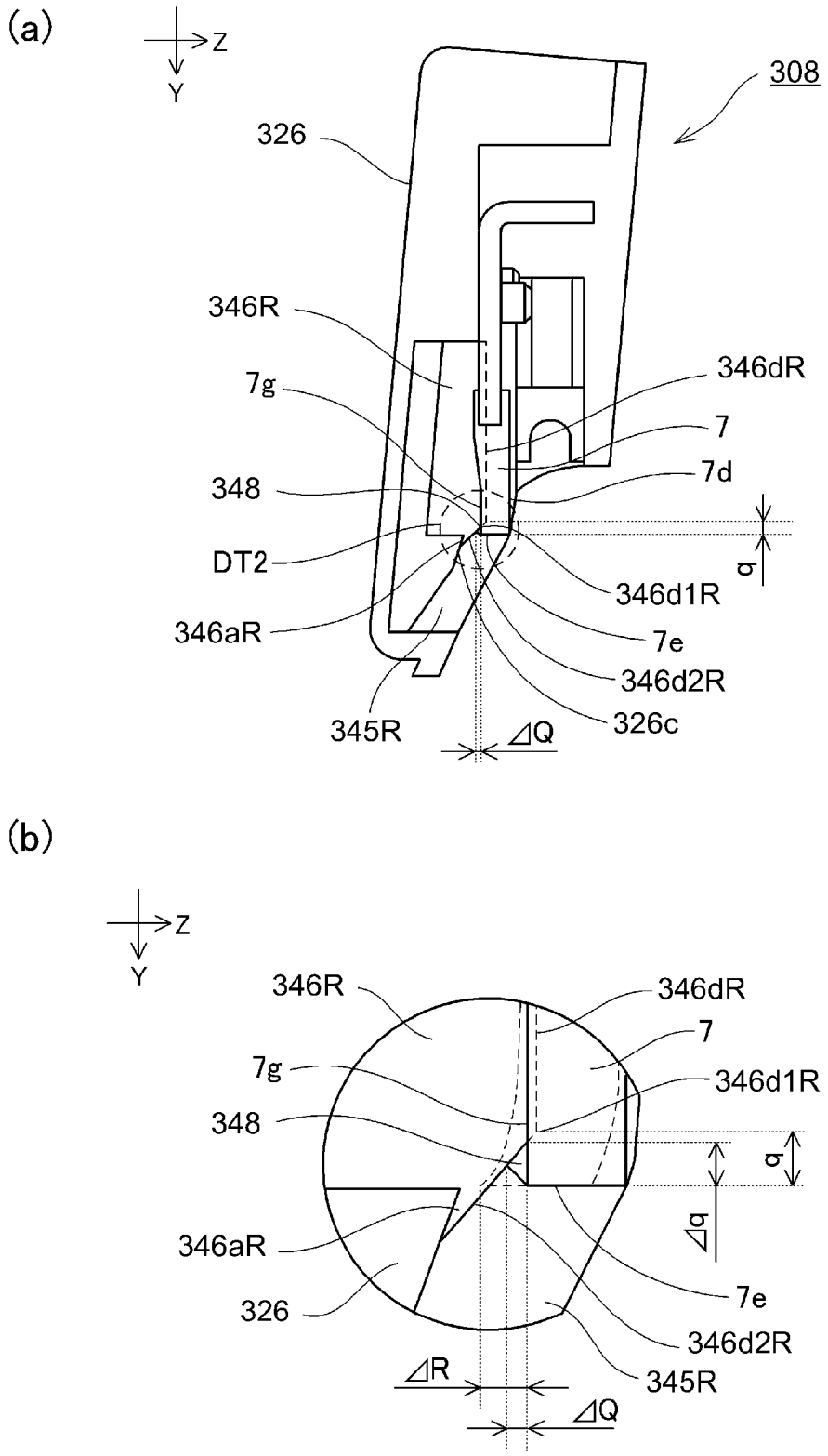
FIG. 20 is a drawing which shows how the lengthwise right end portion of the cleaning unit is sealed in the fourth embodiment.

Next, referring to FIG. 20, another effect of the structural arrangement for the cleaning unit in the fourth embodiment is described in comparison to that in the third embodiment. FIG. 20 is a drawing which shows the structural arrangement, in the fourth embodiment, for keeping the cleaning unit sealed at its lengthwise ends. More specifically, FIG. 20(*a*) is a drawing which shows the gap which occurs between the cleaning blade and end seal, and FIG. 20(*b*) is an enlarged view of the inward side of the area DT2 encircled by a dotted line in FIG. 20(*a*).

Referring to FIG. 19(*a*), in the third embodiment, the vertical seal 246R is positioned so that end surface 7*e* of the cleaning blade 7 becomes roughly level with the cleaning unit frame contacting surface 246*b*2R of the vertical seal 246R in terms of the direction Y. However, because of the tolerance in component dimension, the end surface 7*e* of the cleaning blade 7 protrudes beyond the end seal contacting surface 246*b*1R of the vertical seal 246R in the direction Y by a distance Δn, as shown in FIGS. 19(*a*) and 19(*b*). Therefore, the contacting surface 245*b*R of the end seal 245R comes into contact with the end surface 7*e* of the cleaning blade 7 before it comes into contact with the end seal contacting surface 246*b*1R of the vertical seal 246R. Therefore, a gap 247, the width of which in terms of the direction Z is ΔN, is created by the cleaning unit frame 226, cleaning blade 7, end seal 245R, and vertical seal 246R.

However, the vertical seal 246R is formed of an elastic substance. Therefore, as it is squashed by the cleaning blade 7, its deformable portion 246*f*R extends in the direction Y by a distance Δn1, as indicated by the dotted lines in FIG. 19(*b*). Similarly, as the end seal 245R is squashed by the photosensitive drum 4, its deformable portion 245*f*R extends in the direction −Y by a distance int. That is, the vertical seal 246R and end seal 245R seal the gap 247 with their deformable portions 246*f*R and 245*f*R, respectively. ((Δn1+Δn2)≥Δn). However, there are limits to the distances Δn1 and Δn2 by which the vertical seal 246R and 245R deform (extend), respectively. Therefore, the tolerance in component dimension, and the tolerance in assembly have to be strictly controlled. Therefore, the third embodiment possibly increases the cleaning unit in cost.

In comparison, in the case of the fourth embodiment, the vertical seal 346R is provided with the protrusive portion 346*a*R, which is roughly in the form of a wedge and protrudes in the direction Y beyond the end surface 7*e* of the cleaning blade 7 as shown in FIG. 20(*a*). FIGS. 20(*a*) and 20(*b*) show the state of the cleaning unit 308 after the attachment of the vertical seal 346R, cleaning blade 7, and end seal 345R to the cleaning unit frame 326. When the cleaning unit frame 308 is in the state shown in FIGS. 20(*a*) and 20(*b*), the end surface 7*e* of the cleaning blade 7 is at a point which is away in the direction Y from the starting point ridge 346*d*1R by a distance q.

Referring to FIG. 20(*b*), before the attachment of the photosensitive drum 4, it is possible that the gap 348, which is Δq in dimension in terms of the direction Y will be created by the cleaning blade 7, vertical seal 346R, and end seal 345R. However, the vertical seal 346R is provided with the protrusive portion 346*a*R, which is wedgie in cross section, and the starting point ridge 346*d*1R is in the position in which it airtightly contacts the bottom surface 7*g* of the cleaning blade 7. Further, the distance ΔQ between the slanted surface 346*d*2R and the bottom surface of the cleaning blade 7 in terms of the direction Z is minute.

Here, the cleaning blade 7, which is in contact with the photosensitive drum 4 (FIG. 15(*b*)), deforms in the direction −Z by an amount ΔR as indicated by the dotted lines in FIG. 20(*b*). Since the distance ΔQ is sufficiently smaller than the amount ΔR of the deformation of the cleaning blade 7, the cleaning blade 7 can seal the minute gap 348 by being deformed. In the fourth embodiment, therefore, the attachment of the photosensitive drum 4 prevents the occurrence of the above-described gap 348. Incidentally, the structural arrangement, in the fourth embodiment, for preventing the waste toner from leaking from the cleaning unit at the lengthwise end of the cleaning blade 7 on the drive side is the same as that at the lengthwise end of the cleaning blade 7 on the non-drive side. Therefore, it is not described.

As described above, in the fourth embodiment, as the cleaning blade 7 and photosensitive drum 4 are attached, the vertical seal 346 is compressed, deforming thereby in a manner to extend to the adjacencies of the end seal 345. Thus, it is possible to prevent the problem that a gap occurs between the vertical seal 346 and end seal 345. Therefore, it is possible to improve the cleaning unit 308 in terms of the prevention of the waste toner leakage. Further, the protrusive portion 346*a* of the vertical seal 346 is compressed, being thereby deformed in such a manner that it extends to the adjacencies of the end seal 345 which is positioned next to the vertical seal 346. Consequently, the end seal 345 is made to press on the photosensitive drum 4, increasing thereby the contact pressure between the end seal 345 and photosensitive drum 4. Therefore, the area of contact between the end seal 345 and photosensitive drum 4 is better sealed. Further, the portion of the protrusive portion 346*a*, which comes into contact with the end seal 345 is roughly in the form of a wedge having the slanted surface 346*d*2R. Therefore, the amount by which the end seal 345 is made to warp as it runs onto the protrusive portion 346*a* can be minimized. Thus, it is allowed to reduce the protrusive portion 345*a* of the end seal 345 in length.

Therefore, it is possible to keep the area of contact between the end seal 345 and cleaning blade 7 satisfactorily sealed, without adding to the cost of the end seal 345.

According to the present invention, it is possible to provide a cleaning unit which is low in cost, and high in its ability to keep developer sealed.

While the invention has been described with reference to exemplary embodiments, it is to be understood that the invention is not limited to the disclosed exemplary embodiments. The scope of the following claims is to be accorded the broadest interpretations as to encompass all such modifications and equivalent structures and functions.

This application claims priority from Japanese Patent Applications Nos. 201857/2012 and 201898/2012 filed Sep. 13, 2012 and Sep. 13, 2012, respectively, which are hereby incorporated by reference.

What is claimed is:

1. A cleaning unit usable with an image forming apparatus, said cleaning unit comprising:

a frame;

a developer accommodating portion for accommodating a developer;

a cleaning blade, supported by said frame and including a free end contactable to an image bearing member, for removing a developer from the image bearing member;

a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member includes:

(i) a seal portion contacting said cleaning blade, and (ii) a seat portion to which at least a part of said second sealing member is mounted, said seat portion is deformable to move said second sealing member in a direction of urging said second sealing member to the free end of said cleaning blade when the image bearing member is mounted to said frame.

2. A cleaning unit according to claim 1, further comprising a space for permitting the deformation of said seat portion.

3. A cleaning unit according to claim 2, wherein a size of said seal portion measured in the longitudinal direction is smaller than that of said seat portion.

4. A cleaning unit according to claim 1, wherein said second sealing member is provided at a position upstream of the free end of said cleaning blade with respect to a rotational moving direction of said image bearing member.

5. A cleaning unit according to claim 1, wherein said seat portion has a thickness measured in a direction in which said seat portion is compressed, which thickness increases toward the free end of said cleaning blade.

6. A cleaning unit according to claim 1, wherein said second sealing member includes an L-shaped projected portion which projects in the longitudinal direction outwardly beyond an end surface of said cleaning blade and which extends in a direction from the free end of said cleaning blade toward a base portion thereof.

7. A cleaning unit according to claim 6, wherein said first sealing member further includes a second seat portion to which at least a part of said second sealing member is mounted, said second seat portion is deformable to move said second sealing member in a direction of urging said second sealing member to the end surface of said cleaning blade when the image bearing member is mounted to said frame.

8. A cleaning unit according to claim 1, wherein said image bearing member is a photosensitive drum.

9. A cleaning unit according to claim 1, wherein said image bearing member is an intermediary transfer belt for receiving a developed image.

10. A cleaning unit usable with an image forming apparatus, said cleaning unit comprising:

a frame;

a developer accommodating portion for accommodating a developer;

a cleaning blade, supported by said frame and including a free end contactable to an image bearing member, for removing a developer from the image bearing member;

a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member is deformable to urge said second sealing member toward said cleaning blade.

11. A cleaning unit according to claim 10, wherein said first sealing member is provided with a portion sandwiched between said frame and said second sealing member, and said portion is deformable in a direction of urging said second sealing member to the image bearing member by said cleaning blade being mounted to said frame.

12. A cleaning unit according to claim 11, wherein said portion includes an inclined surface contacting said second sealing member.

13. A process cartridge detachably mountable to a main assembly of an image forming apparatus, said process cartridge comprising:

an image bearing member;

a frame;

a developer accommodating portion for accommodating a developer;

a cleaning blade, supported by said frame and including a free end contactable to an image bearing member, for removing a developer from the image bearing member;

a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member includes:

(i) a seal portion contacting said cleaning blade, and (ii) a seat portion to which at least a part of said second sealing member is mounted, said seat portion is deformable to move said second sealing member in a direction of urging said second sealing member to the free end of said cleaning blade when the image bearing member is mounted to said frame.

14. A process cartridge according to claim 13, further comprising a space for permitting the deformation of said seat portion.

15. A process cartridge according to claim 14, wherein a size of said seal portion measured in the longitudinal direction is smaller than that of said seat portion.

16. A process cartridge according to claim 1, wherein said second sealing member is provided at a position upstream of the free end of said cleaning blade with respect to a rotational moving direction of said image bearing member.

17. A process cartridge according to claim 13, wherein said seat portion has a thickness measured in a direction in which said seat portion is compressed, which thickness increases toward the free end of said cleaning blade.

18. A process cartridge according to claim 13, wherein said second sealing member includes an L-shaped projected portion which projects in the longitudinal direction outwardly beyond an end surface of said cleaning blade and which extends in a direction from the free end of said cleaning blade toward a base portion thereof.

19. A process cartridge according to claim 18, wherein said first sealing member further includes a second seat portion to which at least a part of said second sealing member is mounted, said second seat portion is deformable to move said second sealing member in a direction of urging said second sealing member to the end surface of said cleaning blade when the image bearing member is mounted to said frame.

20. A process cartridge according to claim 13, wherein said image bearing member is a photosensitive drum.

21. A process cartridge detachably mountable to a main assembly of an image forming apparatus, said process cartridge comprising:

an image bearing member;

a frame;

a developer accommodating portion for accommodating a developer;

a cleaning blade, supported by said frame and including a free end contactable to an image bearing member, for removing a developer from the image bearing member;

a first sealing member provided between said frame and said cleaning blade by injection molding into said frame adjacent to a longitudinal end portion of said cleaning blade, said first sealing member being effective to prevent leakage of the developer from said developer accommodating portion; and a second sealing member provided between the image bearing member and said frame in contact with the free end of said cleaning blade adjacent to the longitudinal end portion, wherein said first sealing member is deformable to urge said second sealing member toward said cleaning blade.

22. A process cartridge according to claim 21, wherein said first sealing member is provided with a portion sandwiched between said frame and said second sealing member, and said portion is deformable in a direction of urging said second sealing member to the image bearing member by said cleaning blade being mounted to said frame.

23. A process cartridge according to claim 22, wherein said portion includes an inclined surface contacting said second sealing member.

24. A process cartridge according to claim 21, wherein said image bearing member is a photosensitive drum.

25. An image forming apparatus for forming an image on a recording material, said image forming apparatus comprising:

(A) a process cartridge dismountably mounted to a main assembly of said apparatus, said process cartridge including:

an image bearing member, a frame, a developer accommodating portion for accommodating a developer, a cleaning blade, supported by said frame and including a free end contactable to said image bearing member, for removing a developer from said image bearing member, a first sealing member provided between said frame and said cleaning blade by injection molding into said frame adjacent to a longitudinal end portion of said cleaning blade, said first sealing member being effective to prevent leakage of the developer from said developer accommodating portion, and a second sealing member provided between said image bearing member and said frame in contact with the free end of said cleaning blade adjacent to the longitudinal end portion, wherein said first sealing member includes:

(i) a seal portion contacting said cleaning blade, and (ii) a seat portion to which at least a part of said second sealing member is mounted, said seat portion is deformable to move said second sealing member in a direction of urging said second sealing member to the free end of said cleaning blade when said image bearing member is mounted to said frame; and (B) feeding means for feeding the recording material.

26. An image forming apparatus for forming an image on a recording material, said image forming apparatus comprising:

(A) a process cartridge dismountably mounted to a main assembly of said apparatus, said process cartridge including:

an image bearing member, a frame, a developer accommodating portion for accommodating a developer, a cleaning blade, supported by said frame and including a free end contactable to said image bearing member, for removing a developer from said image bearing member, a first sealing member provided between said frame and said cleaning blade by injection molding into said frame adjacent to a longitudinal end portion of said cleaning blade, said first sealing member being effective to prevent leakage of the developer from said developer accommodating portion, and a second sealing member provided between said image bearing member and said frame in contact with the free end of said cleaning blade adjacent to the longitudinal end portion, wherein said first sealing member is deformable to urge said second sealing member toward said cleaning blade; and (B) feeding means for feeding the recording material.

27. A unit usable with an image forming apparatus, said unit comprising:

a frame;

a developer accommodating portion for accommodating a developer;

a blade supported by said frame and including a free end contactable to a rotatable member;

a first sealing member provided between said frame and said blade by injection molding into said frame adjacent to a longitudinal end portion of said blade, said first sealing member being effective to prevent leakage of the developer from said developer accommodating portion; and a second sealing member provided between the rotatable member and said frame in contact with the free end of said blade adjacent to the longitudinal end portion, wherein said first sealing member includes:

(i) a seal portion contacting said blade, and (ii) a seat portion to which at least a part of said second sealing member is mounted, said seat portion is deformable to move said second sealing member in a direction of urging said second sealing member to the free end of said blade when the rotatable member is mounted to said frame.

28. A unit usable with an image forming apparatus, said unit comprising:

a frame;

a developer accommodating portion for accommodating a developer;

a blade supported by said frame and including a free end contactable to a rotatable member;

a first sealing member provided between said frame and said blade by injection molding into said frame adjacent to a longitudinal end portion of said blade, said first sealing member being effective to prevent leakage of the developer from said developer accommodating portion; and a second sealing member provided between the rotatable member and said frame in contact with the free end of said blade adjacent to the longitudinal end portion, wherein said first sealing member is deformable to urge said second sealing member toward said blade.

* * * * *